US007176837B2

(12) United States Patent
Sonoda et al.

(10) Patent No.: US 7,176,837 B2
(45) Date of Patent: Feb. 13, 2007

(54) ANTENNA DEVICE

(75) Inventors: Ryuta Sonoda, Yokohama (JP); Fuminori Watanabe, Yokohama (JP); Koji Ikawa, Yokohama (JP); Kazuhiko Niwano, Yokohama (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 11/185,785

(22) Filed: Jul. 21, 2005

(65) Prior Publication Data

US 2006/0022876 A1 Feb. 2, 2006

(30) Foreign Application Priority Data

Jul. 28, 2004 (JP) ..... 2004-220302
Dec. 22, 2004 (JP) ..... 2004-371952

(51) Int. Cl.
*H01Q 1/38* (2006.01)

(52) U.S. Cl. ..... 343/700 MS

(58) Field of Classification Search ..... 343/700 MS, 343/846, 702, 830, 829, 848
See application file for complete search history.

(56) References Cited

U.S. PATENT DOCUMENTS

| | | | | |
|---|---|---|---|---|
| 4,800,392 | A * | 1/1989 | Garay et al. | 343/700 MS |
| 5,434,579 | A * | 7/1995 | Kagoshima et al. | 343/700 MS |
| 6,512,488 | B2 | 1/2003 | Schantz | 343/795 |
| 6,795,023 | B2 * | 9/2004 | Chen | 343/700 MS |
| 6,995,722 | B2 * | 2/2006 | Komatsu et al. | 343/711 |
| 2004/0100406 | A1 | 5/2004 | Okado | 343/700 MS |
| 2004/0100407 | A1 | 5/2004 | Okado | 343/700 MS |
| 2004/0100408 | A1 | 5/2004 | Okado | 343/700 MS |
| 2005/0052334 | A1 * | 3/2005 | Ogino et al. | 343/866 |
| 2005/0248487 | A1 * | 11/2005 | Okado | 343/700 MS |

FOREIGN PATENT DOCUMENTS

| | | |
|---|---|---|
| JP | 10-150318 | 6/1998 |
| JP | 10-276033 | 10/1998 |
| JP | 3273463 | 2/2002 |
| JP | 2002-164731 | 6/2002 |

OTHER PUBLICATIONS

M. Hammoud, et al., "Matching the input Impedance of a Broadband disc Monopole", Electronics Letters, vol. 29, No. 4, Feb. 18, 1993, pp. 406-407.

Do-Hoon Kwon, et al., "A Small Ceramic Chip Antenna for Ultra-Wideband Systems", UWBST & IWUWBS Conference Proceedings, TA4-3, 2004, pp. 307-311.

Sung-Bae Cho, et al., "Ultra Wideband Planar Stepped-Fat Dipole Antenna For High Resolution Impulse Radar", Asia-Pacific Microwave Conference, 2003, 4 pages.

* cited by examiner

*Primary Examiner*—Trinh Dinh
*Assistant Examiner*—Huedung Mancuso
(74) *Attorney, Agent, or Firm*—Oblon, Spivak, McClelland, Maier & Neustadt, P.C.

(57) ABSTRACT

The radiating conductor in an antenna device comprises first forming elements, second forming elements and third forming elements disposed to be coupled in one direction. The first forming elements are formed in a semi-circular shape, and the third forming elements are formed in a band-like shape and have feed points disposed therein. The first forming elements, the second forming elements and the third forming elements have respective maximum lengths gradually reduced in this order.

26 Claims, 16 Drawing Sheets

ANTENNA DEVICE

BACKGROUND OF THE INVENTION

1. Field of the Invention

The present invention relates to an antenna device, in particular an antenna device, which is suitable for communication in a microwave range (3 to 30 GHz) and a millimeter wave range (30 to 300 GHz) used for communication, distance measuring equipment or broadcast.

2. Discussion of Background

Heretofore, a disc monopole antenna, which is disclosed in M. Hammoud et al, "Matching The Input Impedance of A Broadband Disc Monopole", Electron. Lett., Vol. 29, No. 4, pp. 406–407, 1993, has been known as an antenna having an operating frequency band in a wide band. FIG. 24 is a schematic view showing this disc monopole antenna. This disc monopole antenna is configured to include a planar monopole 201 connected to a coaxial line 202. Specifically, the planar monopole 201 is disposed as to be upright with respect to a metal plate 203 at a position away from the metal plate 203 by a distance L. It is possible to provide optimum matching so as to have a desired characteristic by adjusting the distance L.

An antenna, which is shown in FIG. 25 and is disclosed in Japanese Patent No. 3273463, has also been known. This antenna is configured so that a pair of radiating plates 211*a* and 211*b* having a substantially semi-circular shape are disposed. The radiating plates 211*a* and 211*b* are formed by removing substantially semi-circular portions from two conductive plates having a semi-circular shape, the substantially semi-circular portions being smaller than the conductive plates and being concentric with the corresponding conductive plate. Each of the radiating plates 211*a* and 211*b* has a substantially semi-circular cut-out portion 241*a* or 241*b* concentrically formed in a central portion of a concentric circle of the semi-circular shape. The two radiating plates 211*a* and 211*b* are disposed so as to have the apexes 221*a* and 221*b* of the respective circular arcs confronting each other whereby power is fed between the apexes 221*a* and 221*b* of the radiating plates 211*a* and 211*b*. A coaxial cable 231 is disposed along the centerline Ox of the radiating plate 211*b*.

An antenna 253, which is configured to have a semi-circular radiating conductor 251 printed on a ceramic plate 250 and to have a feed point disposed for connection between a signal line and an edge portion 252 of a semi-circular shape of the radiating conductor 251 as shown in FIG. 26, is also disclosed in Do-Hoon Kwon, Yongjin Kim et al, "A Small Ceramic Chip Antenna for Ultra-Wideband Systems", UWBST & IWUWBS 2004 Conference Proceedings, TA4-3, pp. 307–311, 2004. The radiating conductor 251 has a narrow slit 254 formed in the vicinity of the edge portion 252 so as to be capable of adjusting an antenna characteristic. This non-patent document states that this arrangement can realize an antenna having an operating frequency band in a wide band.

An antenna 263, which is shown in FIG. 27 and is disclosed in US-A-2004-0100408, has been also known. This antenna comprises a rectangular radiating conductor 264 disposed on a dielectric member 261, and a ground conductor 262 so as to serve as a monopole antenna.

By the way, the antenna shown in FIG. 24 is a monopole antenna. This antenna is configured to include a radiating element comprising the planar disc monopole 201 and a ground conductor comprising the metal plate 203. The radiating element and the ground conductor are disposed so as to be perpendicular and orthogonal with each other. Accordingly, the radiating element is disposed to be upright with respect to the ground conductor so as to have a three-dimensional configuration, occupying a three-dimensional space as an antenna having a three-dimensional structure. Since the metal plate 203 needs to have about 10 times larger size than the diameter of the radiating conductor forming the planar disc monopole 201 in this configuration, the metal plate has a larger shape of, e.g., 300 mm×300 mm. Thus, the antenna shown in FIG. 24 has such a three-dimensional structure, and the ground conductor also has a large shape. As a result, the antenna shown in FIG. 24 is not suitable for a compact antenna.

In the antenna shown in FIG. 25, when each of the radiating plates 211*a* and 211*b* is formed in a semi-circular shape having a diameter of 150 mm, the lower limit frequency, which has a VSWR (Voltage Standing Wave Ratio) of substantially 2 or below, is 600 MHz. The wavelength λ at this lower limit frequency (600 MHz) is substantially 500 mm. This means that the diameter of the radiating plates 211*a* and 211*b* needs to have a length equal to at least substantially 0.3 time a wavelength in an operating frequency band used in a radio wave. Since the semi-circular radiating plates need to have a diameter having a length equal to at least substantially 0.3 time a wavelength as stated earlier, the outline of the antenna device needs to have a large occupied area, i.e., an antenna area of substantially 0.3 time a wavelength× substantially 0.3 time a wavelength. When an attempt is made to reduce the lower limit frequency of the operating frequency band, the outline of the antenna device needs to be made larger. Accordingly, the antenna shown in FIG. 25 is not suitable for a compact antenna.

Additionally, it is difficult to perform impedance adjustment since power is fed from the coaxial cable 231 to the apexes 221*a* and 221*b*. Accordingly, the antenna shown in FIG. 24 is not an antenna having a high degree of freedom in design.

On the other hand, the antenna 253 shown in FIG. 26 is also a monopole antenna. Accordingly, this antenna needs to have a ground conductor (not shown) in order to serve as an antenna. When the radiating conductor 251 has a semi-circular shape having a diameter of 10 mm, it is required that the ground conductor have a rectangular shape of 30 mm×30 mm and that the antenna 253 has an outline formed in a rectangular shape of 40 mm×30 mm. The lower limit frequency that the antenna thus configured has a VSWR of substantially 2.3 or below is 3.1 GHz. Accordingly, the antenna 253 having such an outline of 40 mm×30 mm needs to have an area of substantially 0.4 time a wavelength× substantially 0.3 time a wavelength with respect to the wavelength of the lower limit frequency of 3.1 GHz. When an attempt is made to reduce the lower limit frequency in order to expand the width of the operating frequency band, the outline of the antenna device needs to be made larger. Accordingly, the antenna shown in FIG. 26 is not suitable for a compact antenna.

Additionally, it is impossible to provide the antenna shown in FIG. 26 as an antenna capable of reducing the lower limit frequency of the operating frequency band and having a high degree of freedom in design since the radiating conductor 251 is fixed in such a semi-circular shape.

Additionally, the antenna shown in FIG. 27 is also a monopole antenna and needs to have a ground conductor. When the radiating conductor has dimensions of 8 mm×10 mm, it is required that the ground conductor have a rectangular shape of 20 mm×35 mm and that the antenna 263 have an outline formed in a rectangular shape of 28 mm×45 mm.

The lower limit frequency that the antenna thus configured has a VSWR of substantially 2 or below is 3 GHz. Accordingly, the antenna 263 having such an outline of 28 mm×45 mm needs to have an area of substantially 0.28 time a wavelength×substantially 0.45 time a wavelength with respect to the wavelength of the lower limit frequency of 3.1 GHz. When an attempt is made to reduce the lower limit frequency in order to expand the width of the operating frequency band, the outline of the antenna needs to be made larger to increase the occupied area of the antenna 263. Accordingly, the antenna shown in FIG. 27 is not suitable for a compact antenna.

SUMMARY OF THE INVENTION

From these viewpoints, it is an object of the present invention to provide a compact antenna device, which is capable of reducing a lower limit frequency, of having a high degree freedom in design and of having a higher gain and a wider band in comparison with the conventional antenna devices, without having an occupied volume as a three-dimensional structure as the conventional antenna devices and without having a large occupied area as a substantially planar structure.

In order to attain the object stated earlier, the present invention provides antenna devices stated below:

According to a first aspect of the present invention, there is provided an antenna device comprising:

a dielectric member or a dielectric substrate and a radiating conductor formed in or on the dielectric member or the dielectric substrate, the radiating conductor being formed in a planar shape;

the radiating conductor having a conductor shape defined by a first forming element, a second forming element and a third forming element disposed in one direction, the radiating conductor being configured in such a single shape that the first forming element and the second forming element are jointed together and that the second forming element and the third forming element are jointed together;

the first forming element being formed in a shape selected among a semi-circular shape, a substantially semi-circular shape, a semi-oval shape, a substantially semi-oval shape, an arched shape and a substantially arched shape;

the third forming element being formed in a shape selected among a band-like shape, a substantially band-like shape, a rectangular shape and a substantially rectangular shape;

the first forming element and the third forming element being disposed to be apart from each other;

the second forming element being disposed to bridge a gap between the first forming element and the third forming element; and the third forming element having a feed point disposed therein;

wherein when it is assumed that the semi-circular shape, the substantially semi-circular shape, the semi-oval shape, the substantially semi-oval shape, the arched shape and the substantially arched shape of the first forming element has a chord extended beyond the second forming element to an edge portion of the third forming element remote from the first forming element, and that the extended portion of the chord is called an imaginary chord, an edge portion of the second forming element close to the imaginary chord and one side of the third forming element close to the imaginary chord overlap or substantially overlap with the imaginary chord; and wherein when maximum vertical lengths of the first forming element, the second forming element and the third forming element in a direction orthogonal to the one direction are represented by $W_1$, $W_2$ and $W_3$, respectively, $W_1$, $W_2$ and $W_3$ are set to satisfy the condition of $W_1>W_2>W_3$.

According to a second aspect of the present invention, there is provided an antenna device comprising:

a dielectric member or a dielectric substrate and a pair of radiating conductors formed in or on the dielectric member or the dielectric substrate, the radiating conductors comprising a first radiating conductor and a second radiating conductor, the first radiating conductor and the second radiating conductor being formed in a planar shape and disposed on the same plane as each other so as to be confront each other;

each of the first radiating conductor and the second radiating conductor having a feed point disposed therein;

the first radiating conductor of the paired radiating conductors having a conductor shape defined by a first forming element, a second forming element and a third forming element disposed in one direction, the radiating conductor being configured in such a single shape that the first forming element and the second forming element are jointed together and that the second forming element and the third forming element are jointed together;

the third forming element of the first radiating conductor being disposed on a confronting side to confront the second radiating conductor;

the first forming element of the first radiating conductor being formed in a shape selected among a semi-circular shape, a substantially semi-circular shape, a semi-oval shape, a substantially semi-oval shape, an arched shape and a substantially arched shape;

the third forming element of the first radiating conductor being formed in a shape selected among a band-like shape, a substantially band-like shape, a rectangular shape and a substantially rectangular shape; and the first radiating conductor having the first forming element and the third forming element disposed to be apart from each other, and the second forming element disposed to bridge a gap between the first forming element and the third forming element;

wherein when it is assumed that the semi-circular shape, the substantially semi-circular shape, the semi-oval shape, the substantially semi-oval shape, the arched shape and the substantially arched shape of the first forming element in the first radiating conductor has a chord extended beyond the second forming element to an edge portion of the third forming element remote from the first forming element, and that the extended portion of the chord is called an imaginary chord, an edge portion of the second forming element close to the imaginary chord and one side of the third forming element close to the imaginary chord overlap or substantially overlap with the imaginary chord; and wherein when maximum vertical lengths of the first forming element, the second forming element and the third forming element in the first radiating conductor in a direction orthogonal to the one direction are represented by $W_{1A}$, $W_{2A}$ and $W_{3A}$, respectively, $W_{1A}$, $W_{2A}$ and $W_{3A}$ are set to satisfy the condition of $W_{1A}>W_{2A}>W_{3A}$.

According to a third aspect of the present invention, there is provided an antenna device comprising:

a dielectric member or a dielectric substrate and a pair of radiating conductors disposed on or in the dielectric member or the dielectric substrate, the radiating conductors comprising a first radiating conductor and a second radiating conductor disposed on the same plane as each other;

the paired radiating conductors being disposed to confront each other along one direction; and the paired radiating conductors having feed points disposed at or in the vicinity of closest portions thereof, the feed points being fed power by paired signal lines extending in parallel with each other;

wherein each of the paired signal lines comprises a first linear portion and a second linear portion disposed in a substantially L-character shape on or in the dielectric member or the dielectric substrate, the first linear portion linearly extending along the one direction, and the second linear portion turning in a direction orthogonal to the one direction and linearly extending from the first linear portion to feed power to the paired radiating conductors; and wherein when the second radiating conductor is one of the paired radiating conductors close to the first linear portion of each of the paired signal lines, and when the first radiating conductor is the other radiating conductor confronting the second radiating conductor, the second radiating conductor has a linear side extending along at least the one direction in the vicinity of the feed points, and the second radiating conductor has a portion close to the paired signal lines cut out so as to have a gradually larger distance than a distance between the paired signal lines and the linear side.

In each of these antenna devices, the dielectric member with the paired radiating conductors disposed therein or thereon is disposed as an antenna body on, e.g., an insulating substrate, and the insulating substrate has a transmission line disposed thereon to be connected to the feed points through signal lines (connection conductors). The transmission line is connected from a direction oblique or substantially perpendicular to the plane where the paired radiating conductors are disposed. In this case, the position where the feed point in each of the third forming elements is located is not limited to an end portion of each of the third forming elements.

In each of the antenna devices according to the present invention, the first forming elements, the second forming elements and the third forming elements, which define the conductor shape of the paired radiating conductors in a planar shape, are disposed along in the one direction. The maximum lengths of the respective forming elements in a direction orthogonal to the disposing direction of the respective forming elements are gradually reduced in the order of the first forming elements, the second forming elements and the third forming elements. Thus, it is possible to realize an antenna device, which has good impedance matching and has a high degree of freedom in design.

By configuring the planar conductors as stated earlier, it is possible to provide an antenna device, which can reduce the lower limit frequency and be made smaller than the conventional antenna devices.

Since the radiating conductors have a planar structure to reduce the occupied space of the antenna, it is possible to provide a surface mount antenna device, which mounts the antenna to a surface of the insulating substrate, such as a circuit board.

In accordance with the present invention, it is possible to dispose the antenna body in the vicinity of an edge portion of the insulating substrate. Accordingly, it is possible to reduce the mounting area of the insulting substrate, which is required for the antenna body. Thus, it is possible to provide an antenna device, which is smaller and has a wider operating frequency band than the conventional antenna devices.

In each of the antenna devices according to the present invention, the paired radiating conductors form a dipole antenna, and each of the radiating conductors comprises the first forming element, the second forming element and the third forming element. By properly adjusting each of the forming elements, it is possible to reduce the antenna area. It is also possible to reduce the lower limit frequency in comparison with the conventional antenna devices.

Additionally, each of the paired signal lines for feeing power to the paired radiating conductors comprises a first linear portion and a second linear portion and is disposed on the dielectric member so as to be formed in an L-character shape. Thus, the dielectric member, which has the paired radiating conductors and the paired signal lines disposed thereon or therein, can be disposed as the antenna body in the vicinity of the edge portion of the insulating substrate. Accordingly, it is possible to reduce the mounting area of the antenna body on the insulating substrate, and it is also possible to realize an antenna device, which is smaller and have a wider operating frequency band than the conventional antenna devices.

Further, since the antenna body can be disposed in the vicinity of the circuit board, it is possible to ensure a wide region required for disposing a peripheral circuit on the circuit board and to make the entire communication equipment smaller.

DETAILED DESCRIPTION OF THE INVENTION

Now, the antenna devices according to the present invention will be described in detail based on preferred embodiments shown in some of the accompanying drawings.

Figure 1:
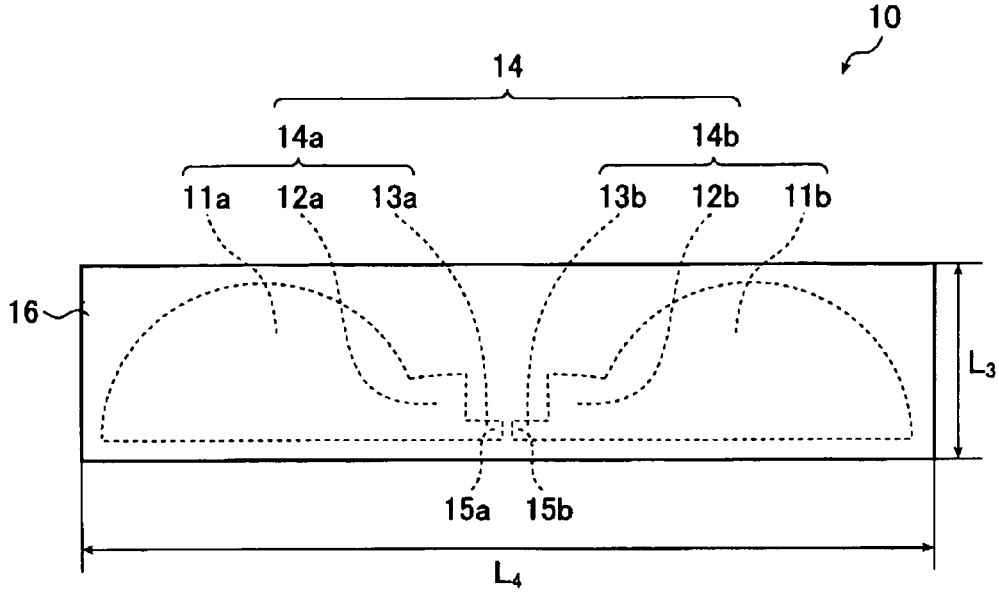
FIG. 1 is a plan view of the antenna body in the antenna device according to an embodiment of the present invention.
Figure 2:
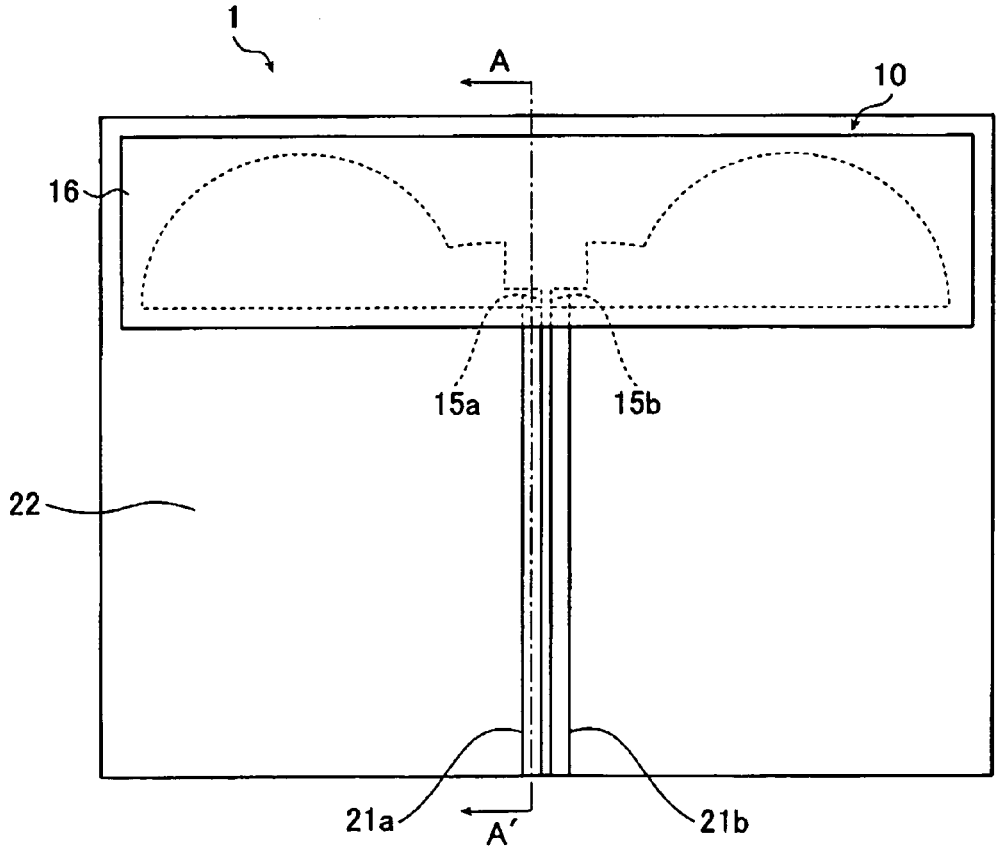
FIG. 2 is a plan view of an antenna device, to which the antenna body shown in FIG. 1 is mounted.
Figure 3:
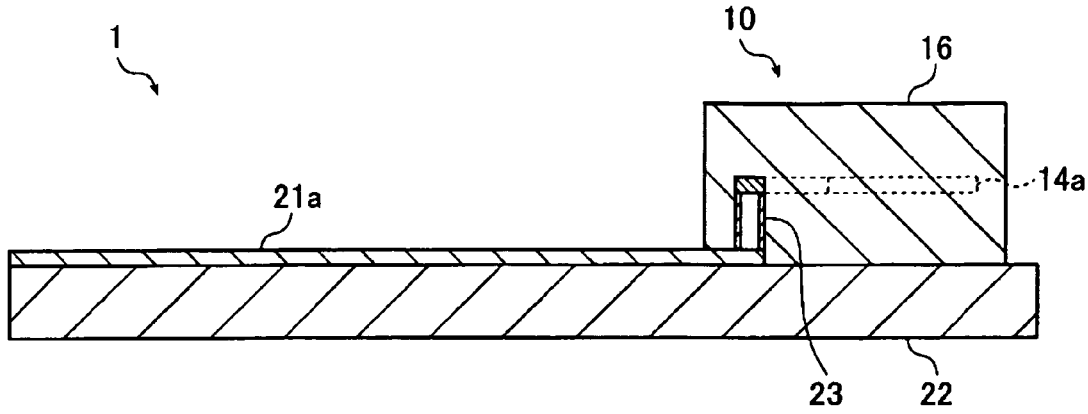
FIG. 3 is a cross-sectional view of the antenna device, taken along line A–A' of FIG. 2 and looking in the direction of arrow A and A'.

FIG. 1 is a plan view of an antenna body 10, which is used in the antenna device 1 according to an embodiment of the present invention. FIG. 2 is a plan view of the antenna device 1. FIG. 3 is a cross-sectional view of the antenna device shown in FIG. 2 taken along line A–A' of FIG. 2 and looking in the direction of arrows A and A'.

The antenna body 10 is a main part of the antenna device 1 serving for transmission and reception of a radio wave. The antenna body 10 is configured to have a radiating conductor 14 disposed in a dielectric member 16, and the antenna body is mounted on a surface of an insulating substrate 22 (see FIG. 2), functioning as a surface-mounted antenna.

The antenna body 10 includes the radiating conductor 14 as a planar metal conductor and the dielectric member 16. The radiating conductor 14 comprises a first radiating conductor 14*a* and a second radiating conductor 14*b* configured to have the same shape as each other and disposed on the same plane as each other in the dielectric member 16. For this reason, the radiating conductors 14*a* and 14*b* are depicted in dotted lines in FIGS. 1 and 2. The radiating conductor 14*a* has a conductor shape defined by a first forming element 11*a*, a second forming element 12*a* and a third forming element 13*a*. The radiating conductor 14*b* has a shape defined by a first forming element 11*b*, a second forming element 12*b* and a third forming element 13*b*, which have the same shapes as the first forming element 11*a*, the second forming element 12*a* and the third forming element 13*a*, respectively. As shown in FIG. 1, the radiating conductor 14*a* and the radiating conductor 14*b* are disposed so as to be axisymmetric or substantially axisymmetric with each other. Although a dielectric substrate may be used in place of the dielectric member 16, explanation will be made about a case wherein the dielectric member is used.

The radiating conductor 14*a* has the first forming element 11*a*, the second forming element 12*a* and the third forming element 13*a* disposed and jointed in this order in the same direction as one another (in the right direction in FIG. 1). The radiating conductor 14*a* is configured in such a single shape that the first forming element 11*a* and the second forming element 12*a* are jointed together and that the second forming element 12*a* and the third forming element 13*a* are jointed together.

The radiating conductor 14*b* has the first forming element 11*b*, the second forming element 12*b* and the third forming element 13*b* disposed and jointed in this order in the same direction as one another (in the left direction in FIG. 1). In other words, the radiating conductor 14*b* is configured in such a single shape that the first forming element 11*b* and the second forming element 12*b* are jointed together and that the second forming element 12*b* and the third forming element 13*b* are jointed together, as in the radiating conductor 14*a*.

Thus, the first forming element 11*a* or 11*b* is apart from the third forming element 13*a* or 13*b*, and the second forming element 12*a* or 12*b* is disposed to bridge a gap between the first forming element 11*a* or 11*b* and the third forming element 13*a* or 13*b*.

The radiating conductor 14*a* and the radiating conductor 14*b* are disposed to be paired in such a way that the disposing direction of the forming elements of the radiating conductor 14*a* and the disposing direction of the forming elements of the radiating conductor 14*b* extend in opposite directions. In other words, the third forming elements 13*a* and 13*b* are disposed to have edges apart from each other and confronting each other.

In FIG. 1, the length in a vertical direction and the length in a horizontal direction are defined as $L_3$ and $L_4$, respectively, in order to define the dimensions of the antenna body 10.

Each of the first forming elements 11*a* and 11*b* has a semi-circular shape, and each of the second forming elements 12*a* and 12*b* has a portion of a ¼ oval shape. Additionally, each of the third forming elements 13*a* and 13*b* has a band-like shape.

Each of the second forming elements 12*a* and 12*b* is a forming element having a portion of a ¼ oval shape, which is surrounded by linear portions extending along the major and minor axes of the entire oval shape and a ¼ oval arc of the entire oval shape. When it is assumed that the ¼ oval shape forming each of the second forming elements has a leading edge of the major axis (see the dotted lines in FIG. 4(*b*)), each of the second forming elements 12*a* and 12*b* is disposed so that the leading edge of the major axis is located in the vicinity of a substantial center (a substantial center of the arc) of each of the first forming elements 11*a* and 11*b*. One linear side of the ¼ oval shape corresponding to the major axis (a lower linear portion in FIGS. 1, 2 and 4) is smoothly jointed to one linear side of the first forming element 11*a* or 11*b* (a lower linear portion in FIGS. 1, 2 and 4) and one linear side of the third forming element 13*a* or 13*b* (a lower linear portion in FIGS. 1, 2 and 4) to form a unified linear portion. In the typical example shown in FIG. 1, the second forming elements 12*a* and 12*b* are formed in a substantially rectangular shape (substantially trapezoidal shape). In other figures than FIG. 1, which will be explained later, when the second forming elements are formed in a substantially rectangular shape, the substantially rectangular shape means a substantially trapezoidal shape.

The radiating conductors 14*a* and 14*b* respectively include feed points 15*a* and 15*b* at edge portions of the third forming elements 13*a* and 13*b* as shown in FIG. 1, and the radiating conductors are respectively connected through vias 23 to signal lines 21*a* and 21*b* of a transmission line disposed on the insulating substrate 22, such as a circuit board stated later, as shown in FIG. 2. Thus, the radiating elements 14*a* and 14*b* are disposed in the dielectric substrate 16 so as to have edges of the third forming elements 13*a* and 13*b* confronting each other on the same plane of the dielectric substrate 16 as each other, forming a dispole antenna.

Figure 4A:
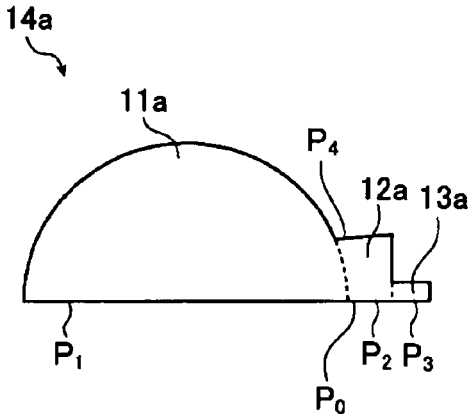
FIGS. 4(*a*) and (*b*) are schematic views explaining the shape of radiating conductors employed in the antenna device according to the present invention.
Figure 4B:
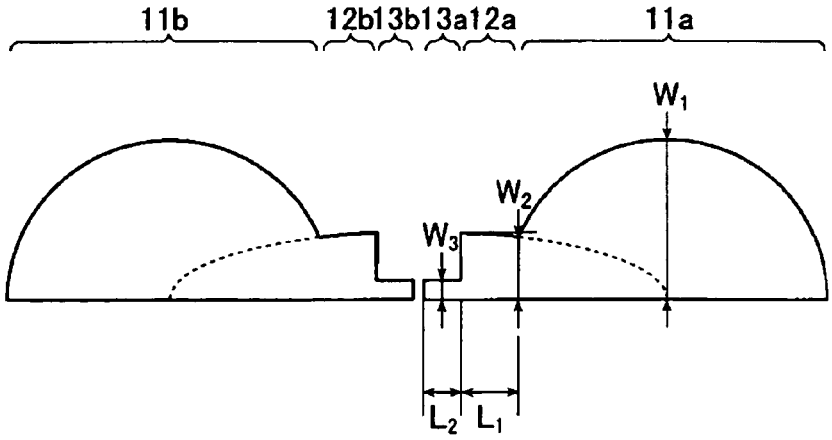

Although the radiating elements 14*a* and 14*b* are configured as stated earlier, the conductor shape of the radiating elements may be explained in a different way as follows:

FIGS. 4(*a*) and (*b*) are schematic views specifically explaining the shape of the radiating element 14. Although the radiating element 14*a* is shown as a typical example in FIG. 4(*a*), the features shown in this figure are also applicable to the radiating element 14*b*.

When it is assumed that the semi-circular shape of the first forming element 11*a* of the radiating element 14*a* has a chord (a linear portion $P_1$) extended to the edge portion of the third forming element 13*a* beyond the second forming element 12*a* as shown in FIG. 4(*a*), the extended linear portion is defined as an imaginary chord $P_0$. In this case, one side (edge portion) $P_2$ of the second forming element 12*a* close to the imaginary chord $P_0$ and one side $P_3$ of the third forming element 13*a* close to the imaginary chord $P_0$ overlap with the imaginary chord $P_0$. Although it is preferred that both sides overlap with the imaginary chord, the antenna device is not limited to have such a fashion, and the antenna device is operable even if both sides substantially overlap with the imaginary chord. A side $P_4$ of the second forming element 12*a* remote from the imaginary chord $P_0$ is formed in an arc shape of a substantially oval shape.

The first forming elements 11*a* and 11*b* may be formed in a shape selected among a semi-circular shape, a substantially semi-circular shape, a semi-oval shape, a substantially semi-oval shape, an arched shape and a substantially arched shape, and the third forming elements may be formed in a shape selected among a band-like shape, a substantially band-like shape, a rectangular shape and a substantially rectangular shape. It is preferred that the side $P_4$ of the second forming elements 12*a* and 12*b* remote from the imaginary chord $P_0$ be formed in an arc shape of a circular shape, a substantially circular shape, an oval shape or a substantially oval shape. It is preferred that the side $P_4$ be formed in an arc shape of, e.g., a ¼ circular shape, a substantially ¼ circular shape, a ¼ oval shape or a substantially ¼ oval shape in the direction orthogonal to the one direction. The side $P_4$ of the second forming elements 12*a* and 12*b* remote from the imaginary chord $P_0$ may be a linear side parallel or substantially parallel with the imaginary chord.

It is also preferred that the imaginary chord $P_0$ overlap or substantially overlap with the one side $P_2$ of the forming elements 12*a* or 12*b*, and the one side $P_3$ of the third forming elements 13*a* or 13*b*.

When the imaginary chord $P_0$ of the radiating element 14*b* is called a second imaginary chord, and when the second imaginary chord is indefinitely extended and called a second extended imaginary chord, the imaginary chord and a portion of the second extended imaginary chord overlap or substantially overlap each other, and a main part of the radiating conductor 14*a* and a main part of the radiating conductor 14*b* are disposed on the same side as each other, having a boundary as the second extended imaginary chord.

In FIG. 4(*b*), respective references $W_1$, $W_2$ and $W_3$ represent maximum vertical lengths (maximum lengths) of the respective forming elements of the first forming elements 11*a* and 11*b*, the second forming elements 12*a* and 12*b*, and the third forming elements 13*a* and 13*b* in a direction orthogonal to the disposing direction thereof (in the vertical direction in each of FIGS. 1, 2, and 4(*a*) and (*b*)). The maximum vertical lengths ($W_{1A}$, $W_{2A}$ and $W_{3A}$) in the first radiating conductor 14*a* and the maximum vertical lengths ($W_{1B}$, $W_{2B}$ and $W_{3B}$) in the second radiating conductor 14*b* are represented by $W_1$, $W_2$ and $W_3$, respectively. The radiating conductors 14*a* and 14*b* are disposed so that $W_1$, $W_2$ and $W_3$ are set to satisfy the following condition (1):

$$W_1 > W_2 > W_3 \quad (1)$$

When the wavelength corresponding to the lower limit frequency of the operating frequency of the antenna 14 (which will be described in detail later) is $\lambda_L$, $W_1$ is preferably $0.2\cdot\lambda_L$ or below, more preferably $0.15\cdot\lambda_L$ or below, in particular preferably $0.1\cdot\lambda_L$ or below. By satisfying the condition (1), the second forming elements 12*a* and 12*b* can be provided with a function to adjust the antenna impedance in terms of capacitance, and the third forming elements 13*a* and 13*b* can be provided with a function to adjust the antenna impedance in terms of inductance. In other words, it is possible to obtain optimum adjustment of the antenna impedance by selecting $W_2$ and $W_3$ so as to satisfy the condition (1). Additionally, the second forming elements 12*a* and 12*b*, and the third forming elements 13*a* and 13*b* can distribute electric currents in the entire radiating conductor 14 to function as antenna elements for effectively radiating a radio wave by selecting $W_2$ and $W_3$ so as to satisfy the condition (1). Specifically, $W_1$ and $W_2$ are set to satisfy preferably the condition of $0.07W_1 \leqq W_2 \leqq 0.6W_1$, more preferably the condition of $0.1W_1 \leqq W_2 \leqq 0.5W_1$, in addition to the condition (1). Additionally, $W_2$ and $W_3$ are set to satisfy preferably the condition of $0.01W_1 \leqq W_3 \leqq 0.06W_1$, more preferably the condition of $0.01W_1 \leqq W_3 \leqq 0.05W_1$, in addition to the condition (1). By satisfying these conditions, it is possible to make the operating frequency band of the antenna wider.

In FIG. 4(*b*), the horizontal length of the second forming elements 12*a* and 12*b*, and the horizontal length of the third forming elements 13*a* and 13*b* are defined as $L_1$ and $L_2$, respectively. The horizontal length of the second forming elements 12*a* and 12*b* means the length projected from an edge of each of the first forming elements 11*a* and 11*b* in the horizontal direction, and the horizontal length of the second forming elements 13*a* and 13*b* means the length projected from an edge of each of the second forming elements 12*a* and 12*b* in the horizontal direction.

From the viewpoint of making the operating frequency wider, it is preferred that the area of the radiating conductor 14*a* be from 0.85 to 1.15 times the area of the radiating conductor 14*b*. This range is more preferably from 0.9 to 1.1 times, in particular from 0.95 to 1.05 times.

The antenna body 10 is mounted to a surface of the dielectric substrate 22 as shown in FIGS. 2 and 3, forming the antenna device 1 serving as an antenna. The dielectric substrate 22 has a strip line as the transmission line, such as a coplanar strip transmission line, formed thereon to feed power to the antenna body 10.

As shown in FIG. 3, the dielectric substrate 22 has the signal lines 21*a* and 21*b* of the coplanar strip transmission line formed on one of the surfaces (the upper surface in FIG.

3), and the dielectric substrate has the antenna body 10 mounted to the surface with the signal lines 21 and 21*b* formed thereon. The antenna body 10 has the radiating conductor 14 formed in the dielectric member 16, and the radiating conductor 14 and the signal lines 21 and 21*b* are connected through the vias 23 disposed in the dielectric member 16. The antenna body 10 is disposed in the vicinity of an edge portion of the insulating substrate 22.

Although the radiating conductor 14 is disposed in the dielectric member 14 in FIG. 3, the radiating conductor may be provided on a surface of the dielectric member 16. The dielectric member 16 may comprise a laminated member. When a laminated member is used, the radiating conductor 14 may be disposed in a surface layer of the laminated member or may be disposed in an inner layer, such as a second layer or a third layer. In the latter case, the radiating conductor 14 may be disposed so as to be sandwich by two layers.

When the dielectric member 16 comprises a laminated member, the laminated member may be formed by laminating similar dielectric layers having a single relative dielectric constant or may be formed by laminating dielectric layers having at least two kinds of different relative dielectric constants.

By disposing the radiating conductor 14 in the dielectric member 16 to utilize a wavelength shortening effect of a dielectric material, the antenna body 10 can be made smaller. In this case, it is possible to determine an effective relative dielectric constant in accordance with the position of the radiating conductor 14, the relative dielectric constant of the dielectric member 16 or a combination of at least two kinds of relative dielectric constants of the dielectric member. Thus, it is possible to obtain a wavelength shortening effect according to an effective relative dielectric constant. By properly selecting and adjusting the effective relative dielectric constant, it is possible to provide the antenna body 10 with a wide operating frequency band.

The connection from the signal lines 21*a* and 21*b* of the strip line to the feed points 15*a* and 15*b* may be made by the vias 23 shown in FIG. 3 or by signal line patterns, which are disposed on an edge of the dielectric member 16. The present invention is not limited to a case where a radiating conductor 14 is disposed in the dielectric member 16. The radiating conductor may be disposed on a substrate surface of the insulating substrate 22. In order to additionally obtain a wavelength shortening effect as stated earlier, a dielectric member may be additionally disposed on the radiating conductor 14, which has been disposed on the substrate surface of the insulating substrate 22. When the radiating conductor 14 is disposed on the substrate surface of the insulating substrate 22, a transmission line, such as a coplanar strip transmission line for feeding power to the radiating conductor 14, and the radiating conductor 14 may be disposed on the same insulating substrate 22.

The antenna device 1 is configured by surface-mounting the antenna body 10 to the insulating substrate 22 as shown in FIGS. 2 and 3. In this case, the transmission line for feeding power to the antenna body 10, e.g., the signal lines of the strip line, such as a coplanar strip transmission line, may be disposed on a surface of the insulating substrate 22 by printing. The insulating substrate 22 may comprise a laminated substrate.

The transmission line, which is formed on the insulating substrate 22 to feed power to the antenna body 10, is not limited to a coplanar strip transmission line and may comprise a coplanar line, wherein a ground conductor and the signal lines are disposed on the same surface of the insulating substrate 22. The antenna body 10 may be mounted to a surface with the coplanar line disposed thereon or the opposite surface thereof.

A portion of the dielectric member 16, which forms the antenna body 10, or the insulating substrate 22 may have a terminal disposed thereon so as to fixedly mount the antenna body 10 to the insulating substrate 22 by, e.g., soldering. By disposing such a terminal at plural positions, it is possible to prevent the antenna body 10 from falling out of the insulating substrate 22 during handling even when the antenna device is employed in communication equipment, such as radio communication equipment. Such a terminal may be employed to contact between the signal lines 21 of the strip line formed on the insulating substrate 22 and the radiating conductor 14 disposed in the dielectric member 16 by, e.g., soldering for instance. In this case, prevention against falling-out and electrical connection can be simultaneously realized.

The radiating conductor may be formed by a conductive plate, such as a metal plate, instead of the radiating conductor 14. In this case, a twin-lead line or a coaxial cable is used and connected to the feed points 15*a* and 15*b* to feed power the same.

The antenna device thus configured may be appropriately employed as an antenna device for transmission and reception of a linearly polarized wave.

Figure 5:
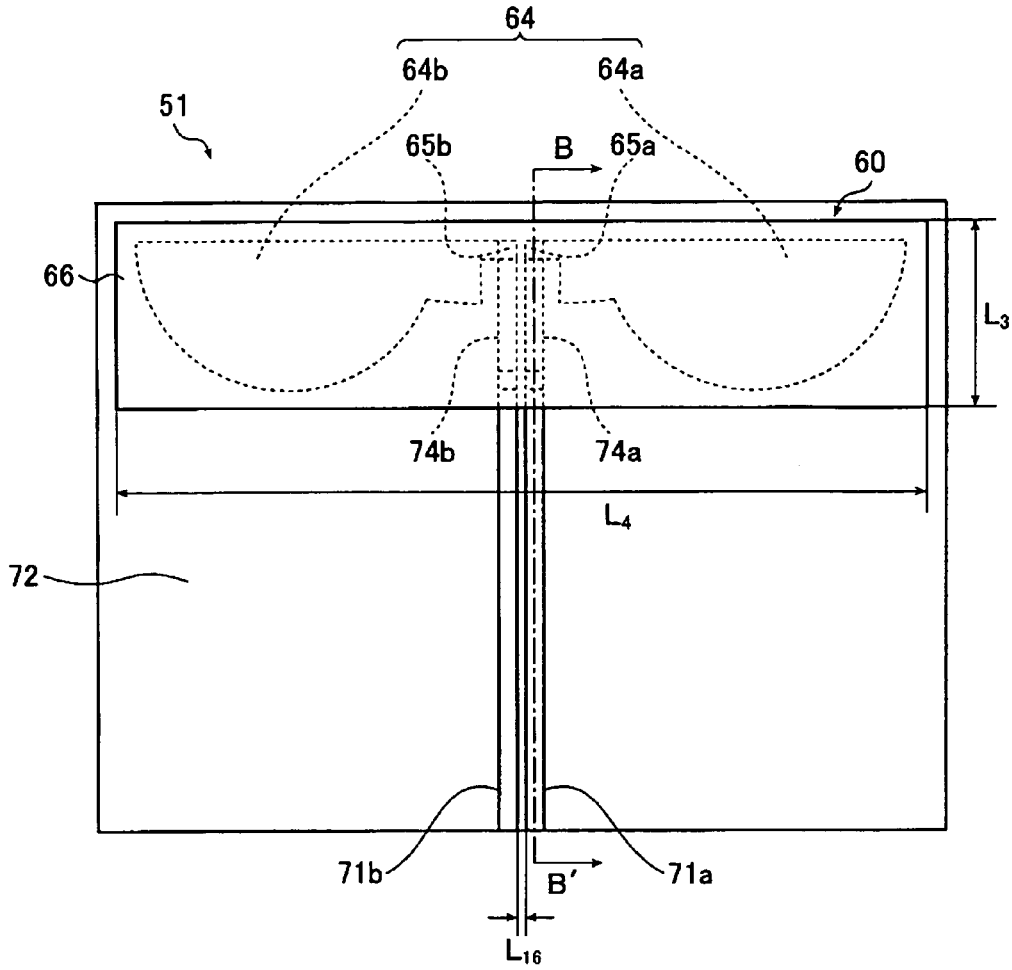
FIG. 5 is a plan view of the antenna device according to another embodiment of the present invention.
Figure 6:
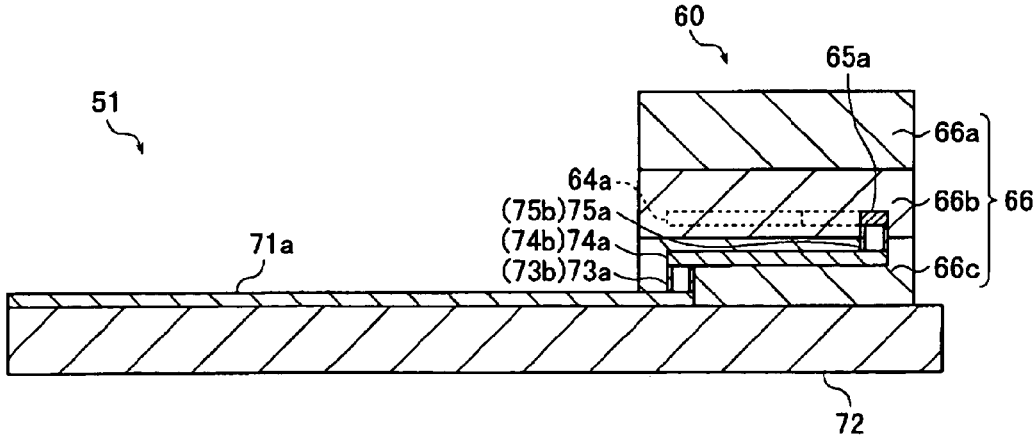
FIG. 6 is a cross-sectional view of the antenna device, taken along line B–B' of FIG. 5 and looking in the direction of arrows B and B'.

FIG. 5 is a plan view of the antenna device 51 according to another embodiment of the present invention, which is different from the antenna device 1 shown in FIG. 2. The antenna device 51 includes an antenna body 60 instead of the antenna body 10 shown in FIG. 2. FIG. 6 is a cross-sectional view of the antenna device 51 shown in FIG. 5, taken along line B–B' of FIG. 5 and looking in the direction of arrows B and B'.

The antenna device 51 includes the antenna body 60 serving for transmission and reception of a radio wave, and an insulating substrate 72. The antenna body 60 is disposed in the vicinity of an edge portion of the insulating substrate 72.

A dielectric member 66 is formed by three kinds of dielectric layers having different relative dielectric constants (a first dielectric layer 66*a*, a second dielectric layer 66*b* and a third dielectric layer 66*c*).

The dielectric member 66 has a radiating conductor 64 disposed therein at a substantially central portion in a thickness direction thereof, i.e., in the second dielectric layer 66*b*. The third dielectric layer 66*c* has respective signal lines 74*a* and 74*b* disposed therein, and the respective signal lines 74*a* and 74*b* are connected to respective radiating conductors 64*a* and 64*b* through respective vias 75*a* and 75*b*. The respective junction points form respective feed points 65*a* and 65*b*. Additionally, the respective signal lines 74*a* and 74*b* are connected, through respective vias 73*a* and 73*b*, to respective signal lines 71*a* and 71*b* formed on the insulating substrate 72.

Although the dielectric member 66 of the antenna body 60 comprises the three kinds of dielectric layers having different relative dielectric constants, the dielectric member may be comprised two kinds or four kinds of dielectric layers having different relative dielectric constants. When the dielectric member 66 comprises two kinds of dielectric layers, it is preferred that the signal lines 74*a* and 74*b* be disposed in the dielectric layer having a lower dielectric constant. From the viewpoint of reducing the lower limit frequency of the operating frequency, it is preferred that the dielectric layer having a lower dielectric constant have a relative dielectric constant of from 5 to 15. It is more preferred that the dielectric layer having a lower dielectric constant have a relative dielectric constant of from 5 to 10.

The antenna body 60 thus configured is mounted to a surface of the insulating substrate 72, which has a similar structure to the insulting substrate 22.

The insulating substrate 72 has a coplanar strip transmission line disposed on one of the surfaces thereof (an upper surface in FIG. 6), the coplanar strip transmission line including the signal lines 71*a* and 71*b* has transmission lines. Power is fed to the antenna body 60 from the side where the radiating conductor 64 is projected in a semicircular shape (a lower side in FIG. 6). In other words, power is fed to the antenna body 60 from a different side from the antenna body 10 shown in FIG. 2

The insulating substrate 72 has the antenna body 60 mounted to the side with the signal lines 71*a* and 71*b* disposed thereon. The respective signal lines 71*a* and 71*b* are connected to the respective signal lines 74*a* and 74*b* through the respective vias 73*a* and 73*b* disposed in the dielectric member 66. The respective signal lines 74*a* and 74*b* are further connected to the radiating conductor 64 through the respective vias 75*a* and 75*b* disposed in the dielectric member 66. In other words, the signal line 74*a* is connected to the feed point 65*a* through the via 73*b*. The paired signal lines 74*a* and 74*b* function as a coplanar strip line.

The antenna device 51 thus configured can also perform optimum adjustment of the antenna impedance and effectively radiate a radio wave because of having a similar structure to the antenna device 1. Additionally, the antenna body 60 can be made smaller. In this case, it is possible to determine an effective relative dielectric constant in accordance with the position of the radiating conductor 64 or a combination of relative dielectric constants of respective dielectric layers of the dielectric member 66. Thus, it is possible to obtain a wavelength shortening effect according to an effective relative dielectric constant. By properly selecting and adjusting the effective relative dielectric constant, it is possible to provide the antenna body 60 with a wide operating frequency band.

Figure 7:
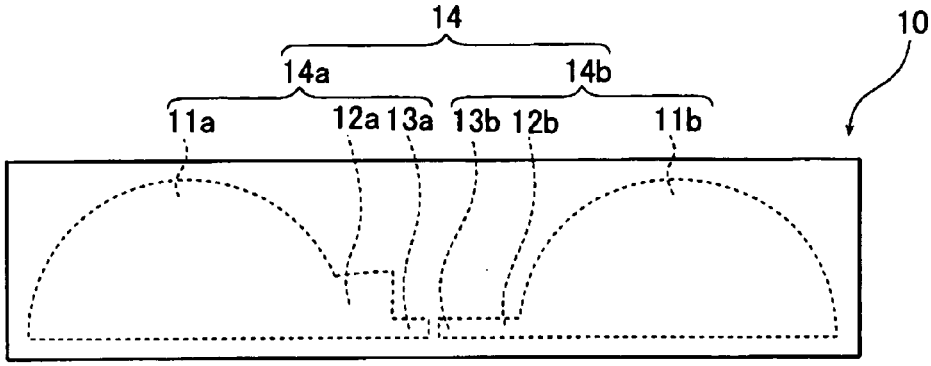
FIG. 7 is a plan view of the antenna body in the antenna device according to another embodiment of the present invention.

The antenna device according to the present invention may employ an antenna device 10 shown in FIG. 7, instead of the antenna body 10 shown in FIG. 1.

In the antenna body 10 shown in FIG. 7, the forming elements of a radiating conductor 14*b* are different from the forming elements of a radiating conductor 14*a* in terms of shape, providing an asymmetrical dipole antenna. Specifically, a second forming element 12*b* is different from a second forming element 12*a* so that $W_1$, $W_2$ and $W_3$ in the radiating conductor 14*a* satisfy the condition of $W_1>W_2>W_3$ while $W_1$, $W_2$ and $W_3$ in the radiating conductor 14*b* satisfy the condition of $W_1>W_2=W_3$ (or $W_1>W_2\approx W_3$). In the radiating conductor 14*b*, a portion of the second forming element 12*b* close to a third forming element 13*b* is formed in a band-like shape, and the remaining portion of the second forming element close to a first forming element 11*b* bridges a gap between the band-like portion and the first forming element 11*b*. The width of the band-like portion of the second forming element 12*b* close to the third forming element 13*b* is the maximum length of the second forming element. In other words, the second forming element 12*a* projects in a lump-like shape in the radiating conductor 14*a* while the second forming element 12*b* does not project in a lump-like shape in the radiating conductor 14*b*. In the case shown in FIG. 7, the second forming element 12*b* is formed in a substantially square shape (a substantially trapezoidal shape).

Figure 8:
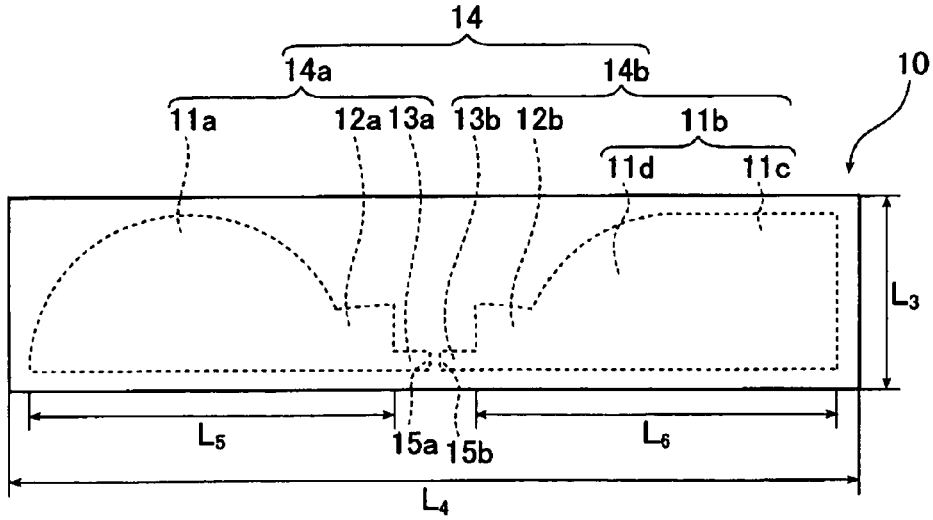
FIG. 8 is a plan view of the antenna body in the antenna device according to another embodiment of the present invention.

The present invention can also employ an antenna body 10 as shown in FIG. 8.

FIG. 8 is a plan view of the antenna body 10, which is employed in the antenna device according to another embodiment of the present invention.

The antenna body 10 includes a radiating conductor 14*a* and a radiating conductor 14*b*. The radiating conductor 14*a* is formed in a similar shape to the radiating conductor 14*a* shown in FIG. 1. The radiating conductor 14*b* has a first forming element 11*b* formed in a different shape from the first forming element 11*b* of the radiating conductor 14*b* shown in FIG. 1. The radiating conductor 14*b* has a second forming element 12*b* and a third forming element 13*b* formed in a similar shape to the radiating conductor 14*a* shown in FIG. 1.

The first forming element 11*b* of the radiating conductor 14*b* is formed in such a shape that a rectangular shape 11*c* and a ¼ circular shape 11*d* are combined. The second forming element 12*b* is formed in a ¼ oval shape, and the third forming element 13*b* is formed in a band-like shape. The length of one linear side of the ¼ circular shape 11*d* and the length of one side of the rectangular shape 11*c* in the first forming element 11*b* are equal to each other, and the first forming element 11*b* is configured that both sides are jointed to gather. The second forming element 12*b* is a forming element having a portion of a ¼ oval shape, which is surrounded by linear portions extending along the major and minor axes of the entire oval shape and a ¼ oval arc of the entire oval shape. Even in the radiating conductor 14*a* shown in FIG. 8, when it is assumed that the ¼ oval shape has a leading edge of the major axis, the second forming element 12*a* is disposed so that the leading edge of the major axis is located in the vicinity of a substantially center (a substantially center of the arc shape) of the first forming element 11*a* as in the radiating conductors 14*a* and 14*b* of the antenna body 10 shown in FIG. 1. When it is assumed that the ¼ oval shape has a leading edge of the major axis in the radiating conductor 14*b* shown in FIG. 8, the second forming element 12*b* is disposed so that the leading edge of the major axis is located in the vicinity of a substantially center (a substantially center of the arc shape) of the ¼ circular shape 11*d*. One linear side of the ¼ oval shape corresponding to the major axis (a lower linear portion in FIG. 8) is smoothly connected to the linear sides of a first forming element 11*a* and the first forming element 11*b* (lower linear portions in FIG. 8), and the linear sides of a third forming element 13*a* and the third forming element 13*b* (lower linear portions in FIG. 1) to form a unified linear portion. In other words, when it is assumed that the radiating conductor 14*b* has the linear side extending, beyond the second forming element 12*b*, to an edge portion of the third forming element 13*b* remote from the first forming element 11*b*, and that the extended linear side is called an imaginary side, the edge portion of the second forming element 12*b* close to the imaginary side and the one side of the third forming element 13*b* close to the imaginary side overlap with the imaginary side. Although it is preferred that the edge portion and the one side overlap with the imaginary side, the antenna device according to the present invention is not limited to such arrangement. The antenna device according to the present invention is operable even if the edge portion and the one side substantially overlap with the imaginary side.

When the imaginary side is indefinitely extended and called an extended imaginary side, the imaginary side and a portion of the extended imaginary side overlap or substantially overlap each other, and a main part of the radiating conductor 14*a* and a main part of the radiating conductor 14*b* are disposed on the same side as each other, having a boundary as the extended imaginary side.

The first forming element 11*a* may be formed in a shape selected among a semi-circular shape, a substantially semi-circular shape, a semi-oval shape, a substantially semi-oval shape, an arched shape and a substantially arched shape. Each of the third forming elements 13*a* and 13*b* may be formed in a shape selected among a band-like shape, a substantially band-like shape, a rectangular shape and a substantially rectangular shape. It is preferred that each of the second forming elements 12*a* and 12*b* have a side $P_4$ (see FIG. 9) formed so as to have an arc shape of a circular shape, a substantially circular shape, an oval shape or a substantially oval shape. It is preferred that the side be formed in an arc shape of, e.g., a ¼ circular shape, a substantially ¼ circular shape, a ¼ oval shape or a substantially ¼ oval shape. The side $P_4$ of each of the second forming elements 12*a* and 12*b* may be a linear side, which is parallel or substantially parallel with a linear side $P_2$ (see FIG. 9) of each of the second forming elements 12*a* and 12*b* on the side remote from the side $P_4$ (a lower side in FIG. 9).

The first forming elements 11*b* may contain a ¼ substantially circular shape, a ¼ oval shape or a ¼ substantially oval shape instead of the ¼ circular shape 11*d*. In the case of such a ¼ oval shape or a ¼ substantially oval shape, a linear side as the minor axis is set so as to be equal to the length of a side of the rectangular shape 11*c*, and both sides are jointed together.

Figure 9:
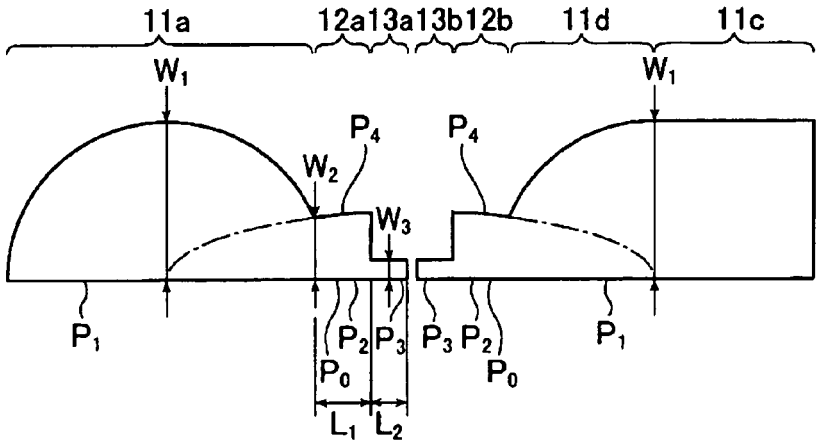
FIG. 9 is a schematic view explaining the shape of the antenna body shown in FIG. 8.

It is preferred that imaginary straight lines $P_0$ (see FIG. 9) overlap or substantially overlap with the sides $P_2$ of the second forming elements 12*a* and 12*b* close to the imaginary straight lines $P_0$ and with sides $P_3$ of the third forming elements 13*a* and 13*b* close to the imaginary straight lines $P_0$ (see FIG. 9). The imaginary straight lines $P_0$ are extended linear portions on the assumption that linear sides $P_1$ of the semi-circular shape or the ¼ circular shape of the first forming elements 11*a* and 11*b* of the radiating conductors 14*a* and 14*b* are extended to edge portions of the third forming elements 13*a* and 13*b* beyond the second forming elements 12*a* and 12*b*, respectively, as shown in FIG. 9.

In FIG. 8, the vertical length and the horizontal length that specify the dimensions of the antenna body 10 are defined as $L_3$ and $L_4$, respectively. The total horizontal length of the first forming element 11*a* and the second forming element 12*a* in the radiating conductor 14*a* is defined as $L_5$, and the total horizontal length of the first forming element 11*b* and the second forming element 12*b* in the radiating conductor 14*b* is defined as $L_6$.

In FIG. 9, respective references $W_1$, $W_2$ and $W_3$ represent maximum vertical length of the respective forming elements of the first forming elements 11*a* and 11*b*, the second forming elements 12*a* and 12*b*, and the third forming elements 13*a* and 13*b* in a direction orthogonal to the disposing direction thereof (in the vertical direction in FIG. 9). With respect to both of the radiating conductors 14*a* and 14*b*, $W_1$, $W_2$ and $W_3$ of these forming elements (which will be represented by respective references $W_{1A}$, $W_{2A}$ and $W_{3A}$ for the radiating conductor 14*a* and by respective $W_{1B}$, $W_{2B}$ and $W_{3B}$ for the radiating conductor 14*b*) are set to satisfy the condition (1). The expressions of $W_1$, $W_2$ and $W_3$ ($W_{1A}$, $W_{2A}$ and $W_{3A}$, and $W_{1B}$, $W_{2B}$ and $W_{3B}$) are also applicable to the typical examples shown in the subsequent figures.

In FIG. 9, the horizontal length of each of the second forming elements and the horizontal length of each of the third forming elements are defined as $L_1$ and $L_2$, respectively.

When the wavelength corresponding to the lower limit frequency of the operating frequency of the antenna body 10 (which will be described in detail later) is $\lambda_L$, $W_1$ ($W_{1A}$ and $W_{1B}$) is preferably $0.2\cdot\lambda_L$ or below, more preferably $0.15\cdot\lambda_L$ or below, in particular preferably $0.1\cdot\lambda_L$ or below in FIGS. 8 and 9. By satisfying the condition (1), the second forming elements 12*a* and 12*b* can be provided with a function to adjust the antenna impedance in terms of capacitance, and the third forming elements 13*a* and 13*b* can be provided with a function to adjust the antenna impedance in terms of inductance. In other words, it is possible to obtain optimum adjustment of the antenna impedance by selecting $W_2$ and $W_3$ ($W_{2A}$ and $W_{3A}$, and $W_{2B}$ and $W_{3B}$) so as to satisfy the condition (1). Additionally, the second forming elements 12*a* and 12*b*, and the third forming elements 13*a* and 13*b* can distribute electric currents in the entire radiating conductor 14 to function as antenna elements for effectively radiating a radio wave by selecting $W_2$ and $W_3$ ($W_{2A}$ and $W_{3A}$, and $W_{2B}$ and $W_{3B}$) so as to satisfy the condition (1).

Specifically, $W_1$ and $W_2$ ($W_{1A}$ and $W_{2A}$, and $W_{1B}$ and $W_{2B}$) are selected so as to satisfy preferably the condition of $0.07W_1 \leqq W_2 \leqq 0.6W_1$, more preferably the condition of $0.08W_1 \leqq W_2 \leqq 0.6W_1$, in particularly preferably the condition of $0.08W_1 \leqq W_2 \leqq 0.5W_1$, more particularly preferably the condition of $0.1W_1 \leqq W_2 \leqq 0.5W_1$, most preferably the condition of $0.2W_1 \leqq W_2 \leqq 0.5W_1$, in addition to the condition (1). Additionally, $W_1$ and $W_3$ ($W_{1A}$ and $W_{3A}$, and $W_{1B}$ and $W_{3B}$) are selected so as to satisfy preferably the condition of $0.01W_1 \leqq W_3 \leqq 0.06W_1$, more preferably the condition of $0.01W_1W_3 \leqq 0.05W_1$, in addition to the condition (1). By satisfying these conditions, it is possible to make the operating frequency band of the antenna wider.

FIGS. 10(*a*) to (*d*) show various typical examples of the antenna body 10, which includes a radiating conductor formed in a different shape from the radiating conductor 14*b* shown in FIG. 8. The antenna body 10 in each of these typical examples is applicable to the antenna device according to the present invention. In the antenna body 10, one of the paired radiating conductors may be formed in a similar shape to the radiating conductor 14*a* shown in FIG. 1, and the other radiating conductor 14*b* may be arbitrarily formed in a shape so as to have a desired characteristic, without being limited to have a specific shape.

$W_1$, $W_2$ and $W_3$ in the radiating conductor 14*b* shown in FIG. 10(*a*) are set so as to satisfy the condition of $W_1>W_2=W_3$ (or $W_1>W_2\approx W_3$). In a radiating conductor 14*b*, a portion of a second forming element 12*b* close to a third forming element 13*b* is formed in a band-like shape, and the remaining portion of the second forming element close to the first forming element 11*b* is formed in such a shape to bridge a gap between the band-like portion and the first forming element 11*b*. In other words, the second forming element 12*b* comprises the band-like portion and the remaining portion. The width of the band-like shape close to the third forming element 13*b* is the maximum length of the second forming element 12*b*. In other words, an edge portion of the second forming element 12*b* in contact with the third forming element 13*b* is formed so as to have the maximum length of the second forming element 12*b*, being smoothly connected to the third forming element 13*b*. In other words, a second forming element 12*a* of a radiating conductor 14*a* projects in a lump-like shape in the radiating conductor 14*a* while the second forming element 12*b* does not project in a lump-like shape in the radiating conductor 14*b*.

In this case, $W_1$ and $W_2$ ($W_{1A}$ and $W_{2A}$) of the radiating conductor 14*a* are set so as to satisfy preferably the condition of $0.07W_1 \leqq W_2 \leqq 0.6W_1$, more preferably the condition of $0.08W_1 \leqq W_2 \leqq 0.6W_1$, in particularly preferably the condition of $0.08W_1 \leqq W_2 \leqq 0.5W_1$, more particularly preferably the condition of $0.1W_1 \leqq W_2 \leqq 0.5W_1$, most preferably the condition of $0.2W_1 \leqq W_2 \leqq 0.5W_1$, in addition to the condition (1). Additionally, $W_1$ and $W_3$ ($W_{1A}$ and $W_{3A}$) are set so as to satisfy preferably the condition of $0.01W_1 \leqq W_3 \leqq 0.06W_1$, more preferably the condition of $0.01W_1 \leqq W_3 \leqq 0.05W_1$, in addition to the condition (1)

$W_1$ and $W_2$ ($W_{1B}$ and $W_{2B}$) of the radiating conductor 14*b* are set so as to satisfy preferably the condition of $0.01W_1 \leqq W_2(=W_3) \leqq 0.06W_1$, more preferably the condition of $0.01W_1 \leqq W_2(=W_3) \leqq 0.05W_1$, in addition to the condition of $W_1 > W_2$. By satisfying these conditions, the operating frequency band of the antenna is made wider.

The portion of the second forming element 12*b* close to the third forming element 13*b* may be formed in a shape selected among a band-like shape, a substantially band-like shape, a rectangular shape and a substantially rectangular shape. When it is assumed that a different linear side from the linear side stated earlier is extended to an edge portion of the third forming element 13*b* remote from the first forming element 11*b* beyond the second forming element 12*b* in the radiating conductor 14*b*, and that the different extended linear side is called an imaginary side, the edge portion of the second forming element close to the imaginary side and one side of the third forming element 13*b* close to the imaginary side overlap with the imaginary side. Although it is preferred that the edge portion and the one side overlap with the imaginary side, the antenna device is not limited to have such a fashion, and the antenna device is operable even if the edge portion and the one side substantially overlap with the imaginary side.

When the imaginary side is indefinitely extended and called an extended imaginary side, the imaginary side and a portion of the extended imaginary side overlap or substantially overlap each other. A main part of the radiating conductor 14*a* and a main part of radiating conductor 14*b* are disposed on the same side as each other, having a boundary as the imaginary side.

A radiating conductor 14*a* of the antenna body 10 shown in FIG. 10(*b*) is formed in the same shape as the radiating conductor 14*a* in FIG. 10(*a*) while a first forming element 11*b* of a radiating conductor 14*b* of the antenna body is formed in a rectangular shape. In this case, $W_1$ and $W_2$ ($W_{1A}$ and $W_{2A}$, and $W_{1B}$ and $W_{2B}$) are set so as to satisfy preferably the condition of $0.07W_1 \leqq W_2 \leqq 0.6W_1$, more preferably the condition of $0.08W_1 \leqq W_2 \leqq 0.6W_1$, in particularly preferably the condition of $0.08W_1 \leqq W_2 \leqq 0.5W_1$, more particularly preferably the condition of $0.1W_1 \leqq W_2 \leqq 0.5W_1$, most preferably the condition of $0.2W_1 \leqq W_2 \leqq 0.5W_1$, in addition to the condition (1). Additionally, $W_1$ and $W_3$ ($W_{1A}$ and $W_{3A}$, and $W_{1B}$ and $W_{3B}$) are set so as to satisfy preferably the condition of $0.01W_1 \leqq W_3 \leqq 0.06W_1$, more preferably the condition of $0.01W_1 \leqq W_3 \leqq 0.05W_1$, in addition to the condition (1). By satisfying these conditions, the operating frequency band of the antenna is made wider.

A first forming element 11*b* of the antenna body 10 shown in FIG. 10(*c*) is formed in a rectangular shape as in the radiating conductor 14*b* shown in FIG. 10(*b*) while $W_1$, $W_2$ and $W_3$ are set so as to satisfy the condition of $W_1 > W_2 = W_3$ (or $W_1 > W_2 \approx W_3$). In a radiating conductor 14*b*, a portion of a second forming element 12*b* close to a third forming element 13*b* is formed in a band-like shape, and the remaining portion of the second forming element close to the first forming element 11*b* is formed so as to bridge a gap between the band-like portion and the first forming element 11*b*. Thus, the second forming element 12*b* comprises the band-like portion and the remaining portion. The width of the band-like portion close to the third forming element 13*b* is the maximum length of the second forming element 12*b*.

In the radiating conductor 14*b*, an end portion of the second forming element 12*b* in contact with the third forming element 13*b* has the maximum length of the second forming element 12*b*, being smoothly connected to the third forming element 13*b*. In other words, a second forming element 12*a* of a radiating conductor 14*a* projects in a lump-like shape in the radiating conductor 14*a* while the second forming element 12*b* does not project in a lump-like shape in the radiating conductor 14*b*.

In this case, $W_1$ and $W_2$ ($W_{1A}$ and $W_{2A}$) of the radiating conductor 14*a* are set so as to satisfy preferably the condition of $0.07W_1 \leqq W_2 \leqq 0.6W_1$, more preferably the condition of $0.08W_1 \leqq W_2 \leqq 0.6W_1$, in particularly preferably the condition of $0.08W_1 \leqq W_2 \leqq 0.5W_1$, more particularly preferably the condition of $0.1W_1 \leqq W_2 \leqq 0.5W_1$, most preferably the condition of $0.2W_1 \leqq W_2 \leqq 0.5W_1$, in addition to the condition (1). Additionally, $W_1$ and $W_3$ ($W_{1A}$ and $W_{3A}$) are set so as to satisfy preferably the condition of $0.01W_1 \leqq W_3 \leqq 0.06W_1$, more preferably the condition of $0.01W_1 \leqq W_3 \leqq 0.05W_1$, in addition to the condition (1).

Additionally, $W_1$ and $W_2$ ($W_{1B}$ and $W_{2B}$) of the radiating conductor 14*b* are set so as to satisfy preferably the condition of $0.01W_1 \leqq W_2(=W_3) \leqq 0.06W_1$, more preferably the condition of $0.01W_1 \leqq W_2(=W_3) \leqq 0.05W_1$, in addition to the condition of $W_1 > W_2$. By satisfying these conditions, the operating frequency band of the antenna is made wider.

In the typical examples shown in FIGS. 10(*a*) and (*c*), when one side of the first forming element 11*b*, which is adjacent to one side of the first forming element 11*b* between the first forming element 11*b* and the second forming element 12*b*, is called a main side in the radiating conductor 14*b*, when it is assumed that the main side is extended to an edge portion of the third forming element 13*b* remote from the first forming element 11*b* beyond the second forming element 12*b*, and when the extended portion of the main side is called an imaginary straight line, an edge portion of the second forming element 12*b* close to the imaginary straight line and one side of the third forming element close to the imaginary straight line overlap with each other. Although it is preferred that the edge portion and the one side overlap with each other, the antenna device is not limited to have such a fashion, and the antenna device is operable even if the edge portion and the one side substantially overlap with the imaginary straight line.

When the imaginary straight line is indefinitely extended and called an extended imaginary straight line, the imaginary chord and a portion of the extended imaginary straight line overlap or substantially overlap each other.

A main part of the radiating conductor 14*a* and a main part of the radiating conductor 14*b* are disposed on the same side as each other, having a boundary as the extended imaginary straight line.

The antenna body 10 shown in FIG. 10(*d*) is one wherein each of the first forming elements 11*a* and 11*b* of the antenna body 10 shown in FIG. 1 is modified so as to have the semi-circular arc portion formed in a linearly cut-out shape. Each linearly cut-out shape is disposed in parallel with the linear sides of radiating conductors 14*a* and 14*b* (lower linear portions in FIG. 10(*d*)). Such a cut-out shape may be disposed in one of the radiating conductors 14*a* and 14*b*.

Although the radiating conductor 14 formed in such a shape is disposed in the dielectric member 16, the radiating conductor may be provided on a surface of the dielectric member 16. The dielectric member 16 may comprise a laminated member. When a laminated member is used, the radiating conductor 14 may be disposed in a surface layer of the laminated member or may be disposed in an inner layer, such as a second layer or a third layer. In the latter case, the radiating conductor 14 may be disposed so as to sandwich by two layers.

When the dielectric member 16 comprises a laminated member, the laminated member may be formed by laminating similar dielectric layers having a single relative dielectric constant or may be formed by laminating dielectric layers having at least two kinds of different relative dielectric constants.

By disposing the radiating conductor 14 in the dielectric member 16 to utilize a wavelength shortening effect of a dielectric material even in the antenna body 10 according to any one of the typical examples shown in FIGS. 10(*a*) to (*d*), the antenna body 10 can be made smaller. In this case, it is possible to determine an effective relative dielectric constant in accordance with the position of the radiating conductor 14, the relative dielectric constant of the dielectric member 16 or a combination of at least two kinds of relative dielectric constants of the dielectric member. Thus, it is possible to obtain a wavelength shortening effect according to an effective relative dielectric constant. By properly selecting and adjusting the effective relative dielectric constant, it is possible to provide the antenna body 10 with a wide operating frequency band.

Figure 11:
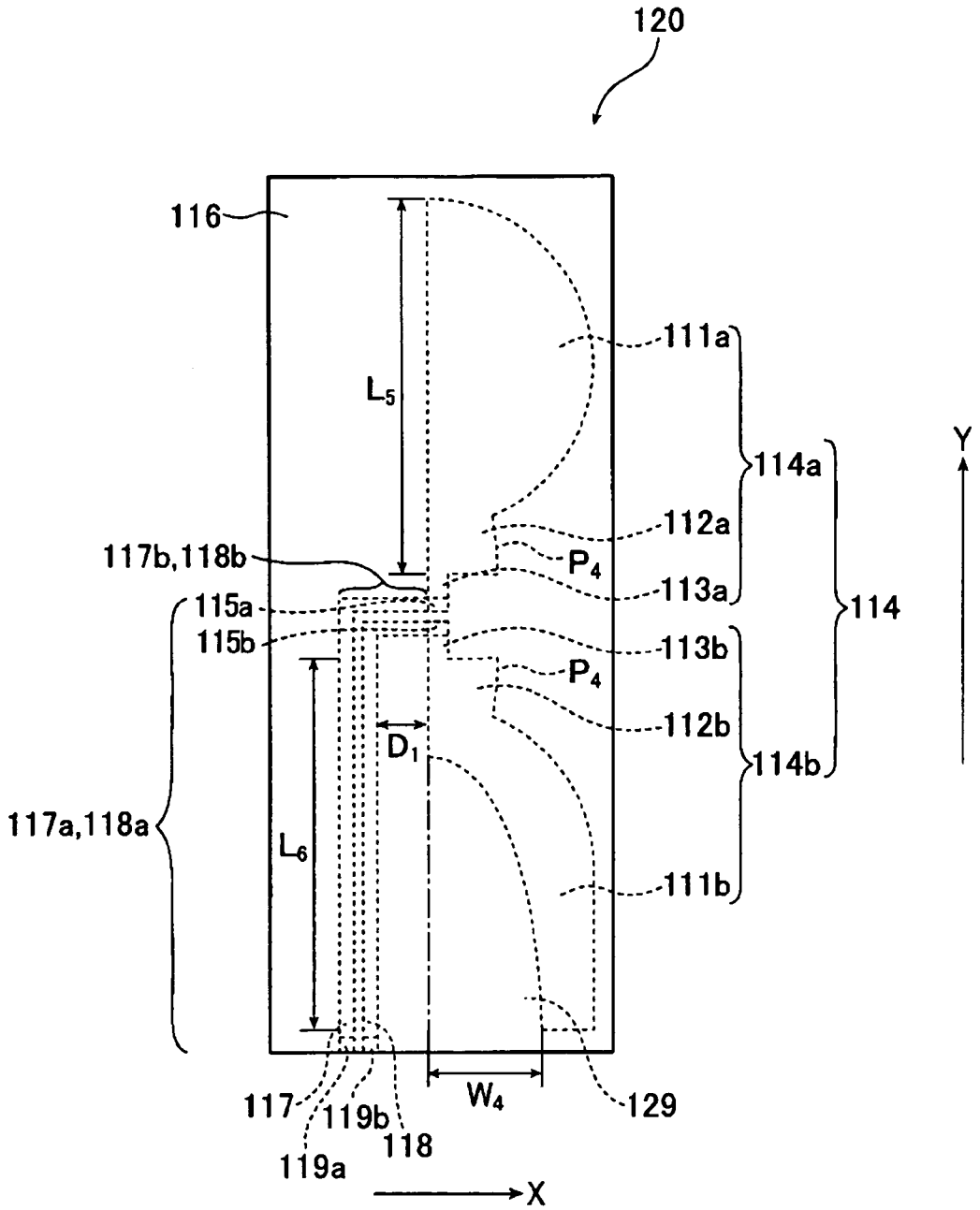
FIG. 11 is a plan view of the antenna body in the antenna device according to another embodiment of the present invention.
Figure 12:
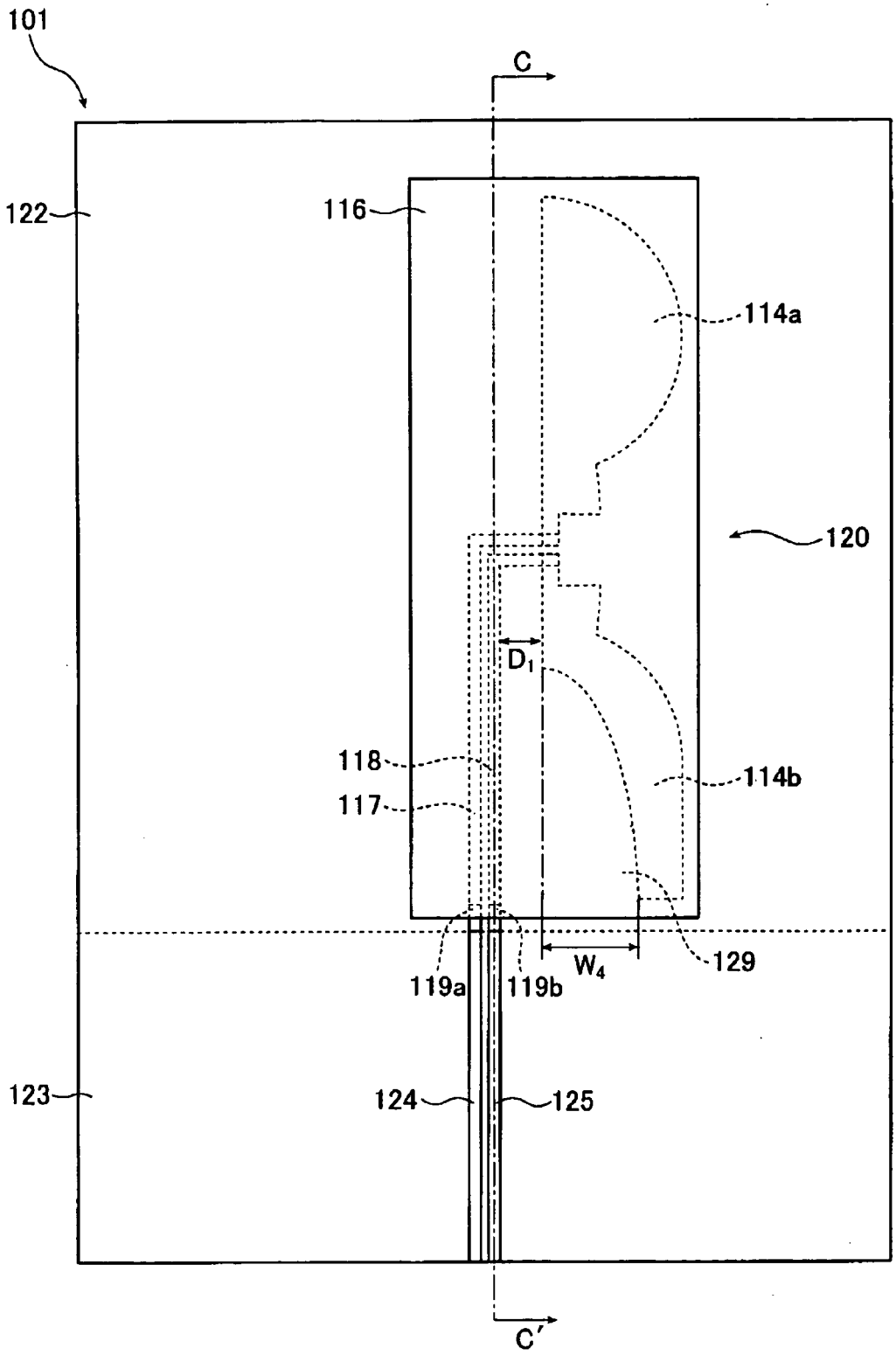
FIG. 12 is a plan view of an antenna device, on which the antenna body shown in FIG. 11 is mounted.
Figure 13:
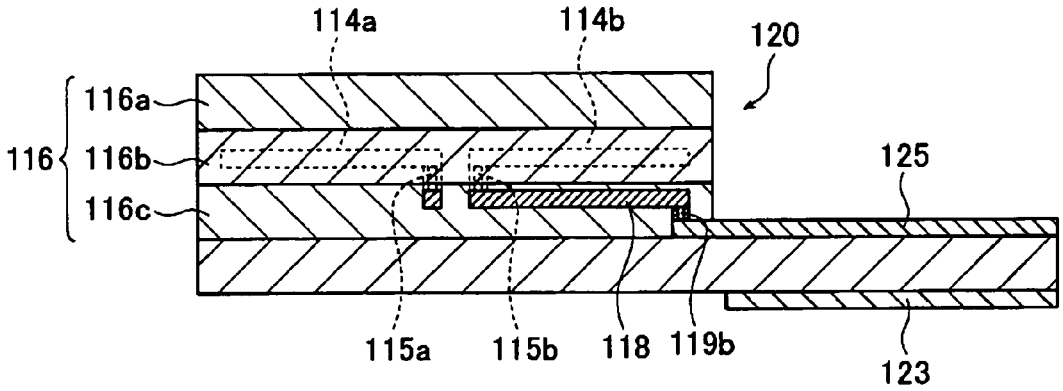
FIG. 13 is a cross-sectional view of the antenna device, taken along line C–C' of FIG. 12 and looking in the direction of arrow C and C'.

FIG. 11 is a plan view of an antenna body 120, which is employed in the antenna device 101 according to another embodiment of the present invention (see FIG. 12). FIG. 12 is a plan view of the antenna device 101. FIG. 13 is a cross-sectional view of the antenna device 101 shown in FIG. 12, taken along line C–C' in FIG. 12 and looking in the direction of arrow C and C'.

The antenna body 120 is a main part of the antenna device 101 serving for transmission and reception of a radio wave. The antenna body 120 is configured to have a radiating conductor 114 as a planar metal conductor, and a pair of signal lines 117 and 118 disposed in a dielectric member 116, and the antenna body is mounted on a surface of an insulating substrate 122 (see FIG. 12), functioning as a surface-mounted antenna.

The radiating conductor 114 comprises a first radiating conductor 114*a* and a second radiating conductor 114*b* formed to have different shapes and disposed on the same plane as each other in the dielectric member 116. For this reason, the radiating conductors 114*a* and 114*b* are depicted in dotted lines in FIGS. 11 and 12. The radiating conductor 114*a* has a conductor shape defined by a first forming element 111*a*, a second forming element 112*a* and a third forming element 113*a*. The radiating conductor 114*b* has a shape defined by a first forming element 111*b*, a second forming element 112*b* and a third forming element 113*b*. The first forming element 111*b* has a cut-out portion 129 formed so as to be cut out in a curved shape.

In other words, the radiating conductor 114*b* is cut out in a curved shape so that a gap between each of first linear portions 117*a* and 118*a* of the paired signal lines 117 and 118, and the radiating conductor 114*b* is gradually expanding from the closest portions of the radiating conductor 114*a* and the radiating conductor 114*b* toward an exterior side in one direction. However, the radiating conductor 114*b* is not limited to have such a shape. The radiating conductor 114*b* may be cut out in at least one of a linear way and a curved way so as to have the gap gradually expanding toward an exterior side in the one direction. The radiating conductor 114*b* has a portion close to the first linear portions 117*a* and 118*a* cut out toward a direction orthogonal to the one direction.

The radiating conductor 114*a* has the first forming element 111*a*, the second forming element 112*a* and the third forming element 113*a* disposed and jointed in this order in the same direction as one another (in the lower direction in FIG. 11). The radiating conductor 114*a* is formed in such a single shape that the first forming element 111*a* and the second forming element 112*a* are jointed together and that the second forming element 112*a* and the third forming element 113*a* are jointed together.

The radiating conductor 114*b* has the first forming element 111*b*, the second forming element 112*b* and the third forming element 113*b* disposed and jointed in this order in the same direction as one another (in the upper direction in FIG. 11). In other words, the radiating conductor 114*b* is formed in such a single shape that the first forming element 111*b* and the second forming element 112*b* are jointed together and that the second forming element 112*b* and the third forming element 113*b* are jointed together, as in the radiating conductor 114*a*.

Thus, the first forming element 111*a* or 111*b* is apart from the third forming element 113*a* or 113*b*, and the second forming element 112*a* or 112*b* is disposed to bridge a gap between the first forming element 111*a* or 111*b* and the third forming element 113*a* or 113*b*.

The radiating conductor 114*a* and the radiating conductor 114*b* are disposed to be paired in such a way that the disposing direction of the forming elements of the radiating conductor 114*a* and the disposing direction of the forming elements of the radiating conductor 114*b* extend in opposite directions. In other words, the third forming elements 113*a* and 113*b* are disposed to have edges apart from each other and confronting each other.

Respective confronting edge portions of the third forming elements 113*a* and 113*b* have respective vias 115*a* and 115*b* disposed as shown in FIG. 13, forming feed points. The radiating conductors 114*a* and 114*b* are respectively connected to signal lines 124 and 125 of a transmission line through the paired signal lines 117 and 118 disposed in the dielectric member 116 as shown in FIGS. 12 and 13, the transmission line being disposed on the insulating substrate 122, such as a circuit board stated later. Thus, the radiating conductors 114*a* and 114*b* are disposed in the dielectric substrate 116 so as to have edges of the third forming elements 113*a* and 113*b* confronting each other on the same plane in the dielectric substrate 116 thereas, forming an asymmetric dipole antenna.

The paired signal lines 117 and 118 comprise twin substantially parallel conductive wires connected to the edges of the third forming elements 113*a* and 113*b* through the respective vias 115*a* and 115*b* and disposed in the dielectric member 116 in order to feed power to the radiating conductors 114*a* and 114*b*. Each of the paired signal lines 117 and 118 comprises the first linear portion 117*a* or 118*a* disposed in parallel with the radiating conductor 114*b* and along a Y-direction, and the second linear portion 117*b* or 118*b* disposed so as to turn at right angles from the Y-direction to an X-direction orthogonal to the Y-direction in order to feed power to the radiating conductors 114*a* and 114*b* from the X-direction. In other words, each of the paired signal lines 117 and 118 has the first linear portion 117*a* or 118*a* and the second linear portion 117*b* or 118*b* formed in a substantially L-character shape.

As shown in FIG. 13, the paired signal lines 117 and 118 are disposed on a different plane from the radiating conductor 114 (114*a* and 114*b*) to feed power to the radiating conductor 114 through the vias 115*a* and 115*b*, which are disposed in a direction perpendicular to the plane with the radiating conductor 114 disposed thereon. As shown in FIG. 12, the paired signal lines 117 and 118 are also connected to the paired signal lines 124 and 125 through vias 119*a* and 119*b*, which are disposed in the perpendicular direction. As shown in FIG. 11, the first linear portions 117*a* and 118*a* of the paired signal lines 117 and 118 are disposed in substantially parallel with the linear sides of the first forming element 111*b*, the second forming element 112*b* and the third forming element 113*b*.

As shown in FIG. 13, the dielectric member 116 comprises three kinds of dielectric layers having different relative dielectric constants (a first dielectric layer 116*a*, a second dielectric layer 116*b* and a third dielectric layer 116*c*).

The dielectric member 116 has the radiating conductor 114 disposed at a central portion in the thickness direction thereof, i.e., in the second dielectric layer 116*b*. The third dielectric layer 116*c* has the paired signal lines 117 and 118 disposed therein. The paired signal lines 117 and 118 are connected to the respective third forming elements 113*a* and 113*b* of the radiating conductors 114*a* and 114*b* through the respective vias 115*a* and 115*b*. The paired signal lines 117 and 118 are also connected, through the respective vias 119*a* and 119*b*, to the signal lines 124 and 125 disposed on the insulating substrate 122.

The antenna body 120 is configured as stated earlier.

Although the radiating conductors 114*a* and 114*b* in the antenna body 120 are formed as stated earlier, the radiating conductors according to the present invention may be formed in any one of the shapes stated below.

The first forming element 111*a* of the radiating conductor 114*a* may be formed in a shape selected among a semi-circular shape, a substantially semi-circular shape, a semi-oval shape, a substantially semi-oval shape, an arched shape and a substantially arched shape. The first forming element 111*b* of the radiating 114*b* may comprise a first portion formed in a shape selected among a ¼ circular shape, a ¼ substantially circular shape, a ¼ oval shape and a ¼ substantially oval shape, and a second portion formed in a rectangular shape (containing an oblong shape and a square shape) and including a side having the same length as one side of the first portion, the side of the second portion being jointed to the one side of the first portion. When the first portion is formed in a ¼ oval shape or a ¼ substantially oval shape, the liner side forming the minor axis is jointed to the second portion formed in such a rectangular shape.

In this case, the first forming element 111*b* has the cut-out portion 129 formed in a portion thereof close to the paired signal lines 117 and 118 so as to be gradually apart from the first linear portions 117*a* and 118*a*. It is preferred that the cut-out portion 129 be configured to be at least partly formed in a curved shape so that the distance between the first linear portions 117*a* and 118*a* of the paired signal lines, and the second radiating conductor 114*b* gradually expands as being farther from the feed points. In the typical example shown in FIG. 11, the cut-out portion is formed in a ¼ oval shape, and the cut-out portion is disposed so that a linear side forming the major axis of the ¼ oval shape is disposed in parallel with the Y-direction in this figure. It is preferred that the cut-out portion is formed in a shape to have an arc shape of a shape selected among a ¼ circular shape, a ¼ substantially circular shape, a ¼ oval shape and a ¼ substantially oval shape. In this case, the cut-out portion is disposed so that the arc portion is directed to a side where the radiating conductors 114*a* and 114*b* are closest to each other (an upper side in this figure, the side of the feed points) and that one linear side of the arc portion (one linear side forming the major axis in the case of a ¼ oval shape) is parallel with the disposing direction of the radiating conductor 114*a* and the radiating conductor 114*b*.

It is preferred that a maximum cut-out width $W_4$ be a maximum length $W_1$ or below (see FIG. 9) on the assumption that the cut-out portion 129 is not formed. More specifically, the maximum cut-out width $W_4$ is set so as to satisfy the condition of $0.03 \leqq W_4/W_1 \leqq 1$, preferably the condition of $0.05 \leqq W_4/W_1 \leqq 1$, more preferably the condition of $0.1 \leqq W_4/W_1 \leqq 1$, most preferably the condition of $0.2 \leqq W_4/W_1 \leqq 1$.

On the other hand, each of the second forming elements 112*a* and 112*b* may have at least one portion formed in a shape selected among a polygonal shape, a substantially polygonal shape, a trapezoidal shape, a substantially trapezoidal shape, a circular shape, a substantially circular shape, a semi-circular shape, a substantially semi-circular shape, an oval shape, a substantially oval shape, a semi-oval shape, a substantially semi-oval shape, a rectangular shape and a substantially rectangular shape.

It is preferred that a side $P_4$ of each of the second forming elements 112*a* and 112*b* (see FIG. 11) be formed in an arc shape of a circular shape, a substantially circular shape, an oval shape or a substantially oval shape. It is preferred that the side $P_4$ have an arc shape of, e.g., a ¼ circular shape, a substantially ¼ circular shape, a ¼ oval shape or a substantially ¼ oval shape. The side $P_4$ of each of the second forming elements 112*a* and 112*b* may be a linear side parallel or substantially parallel with a linear side of each of the second forming elements 112*a* and 112*b* remote from the side $P_4$ (a left side in FIG. 11). Each of the third forming elements 113*a* and 113*b* may be formed in a shape selected among a band-like shape, a substantially band-like shape, a rectangular shape and a substantially rectangular shape.

Although the radiating conductors 114*a* and 114*b* have the same length in the Y-direction, both conductors do not necessarily have the same length. When it is assumed that the length of the radiating conductor 114*a* in the Y-direction is $L_5$ and that the length of the radiating conductor 114*b* in the Y-direction is $L_6$ (see FIG. 11), the value of the ratio of $L_6/L_5$ is preferably 0.5 or above and 1.5 or below, more preferably 0.55 or above and 1.0 or below, in particular preferably 0.5 or above and 0.95 or below, most preferably 0.6 or above and 0.9 or below, in order to make the operating frequency band wider.

Although the dielectric member 116 comprises the three kinds of dielectric layers having different relative dielectric constants, the dielectric member comprise two or four kinds of dielectric layers.

When the dielectric member 116 comprises two kinds of dielectric layers, it is preferred that the paired signal lines 117 and 118 be disposed in a dielectric layer having a lower dielectric constant. It is preferred from the viewpoint of reducing the lower limit frequency of the operating frequency that the dielectric layer having a lower dielectric constant have a relative dielectric constant of from 5 to 15. It is more preferred that the dielectric layer having a lower dielectric constant have a relative dielectric constant of from 5 to 10. The dielectric member 116 may comprise a single kind of dielectric layer having a single relative dielectric constant. The dielectric member 116 may comprise a laminated member. When the dielectric member 116 comprises a laminated member, the radiating conductor 114 may be disposed in a surface layer of the laminated member or may be disposed in an inner layer, such as a second layer or a third layer. In the latter case, the radiating conductor 114 may be disposed so as to be sandwiched between.

By disposing the radiating conductor 114 in the dielectric member 116 to utilize a wavelength shortening effect of a dielectric material, the antenna body 120 can be made smaller. In this case, it is possible to determine an effective relative dielectric constant in accordance with the position of the radiating conductor 114, the relative dielectric constant of the dielectric member 116 or a combination of at least two kinds of relative dielectric constants of the dielectric member. Thus, it is possible to obtain a wavelength shortening effect according to an effective relative dielectric constant. By properly selecting and adjusting the effective relative dielectric constant, it is possible to provide the antenna body 120 with a wide operating frequency band.

Although the radiating conductor 114 is disposed in the dielectric member 116 as shown in FIG. 13, the radiating conductor may be disposed on a surface of the dielectric member 116. The radiating conductor 114 may be disposed not only on or in the dielectric member 116 but also on a surface of the insulating substrate 122. In order to additionally obtain the wavelength shortening effect as stated earlier, the radiating conductor 114, which is disposed on the surface of the insulating substrate 122, may have an additional dielectric member disposed thereon. When the radiating conductor 114 is disposed on the surface of the insulating substrate 122, signal lines for feeding power to the radiating conductor 114, the paired signal lines 117 and 118 and the radiating conductor 114 may be disposed on the same plane of the insulating substrate 122 as one another. It is also acceptable that the radiating conductor 114 is disposed in or on a surface of the dielectric member 116 and that the paired signal lines 117 and 118 are disposed on a surface of the insulating substrate 122. In this case, it is possible to further reduce the length $L_3$ of the dielectric member 116.

Although the paired signal lines 117 and 118 are connected to the paired signal lines 124 and 125 through the vias 119*a* and 119*b* as shown in FIG. 13, signal line patterns may be disposed on an edge of the dielectric member 116 to connect between both pairs through the patterns.

As shown in FIGS. 12 and 13, the antenna body 120 is mounted on a surface of the insulating substrate 122, forming the antenna device 101 serving as antenna. The paired signal lines 124 and 125 of a coupled microstrip transmission line as a transmission line are formed on the surface of insulating substrate 122 with the antenna body 120 mounted thereon, in order to feed power to the antenna body 120. On the other hand, the surface of the insulating substrate remote from the antenna body 120 has a ground conductor 123 disposed thereon.

The signal lines, such as the coupled microstrip transmission line, may be disposed on the insulating substrate 122 by printing. The insulating substrate 122 may comprise a laminated substrate.

The surface of the dielectric member 116 with the antenna body 120 formed thereon or the insulating substrate 122 may have a terminal disposed thereon by, e.g., soldering, so as to fixedly mount the antenna body 120 to the insulating substrate 122. By disposing such a terminal at plural positions, it is possible to prevent the antenna body 120 from falling out of the insulating substrate 122 during handling even when the antenna device is employed in communication equipment, such as a ratio communication equipment. Such terminals may be employed to connect between, e.g., the signal lines 124 and 125 disposed on the insulating substrate 122, and the radiating conductor 114 disposed on the dielectric member 116 by, e.g., soldering. In this case, prevention against falling out and electrical connection can be simultaneously realized.

The antenna device 101 thus configured may be appropriately employed as an antenna device for transmission and reception of a linearly polarized wave.

Figure 14:
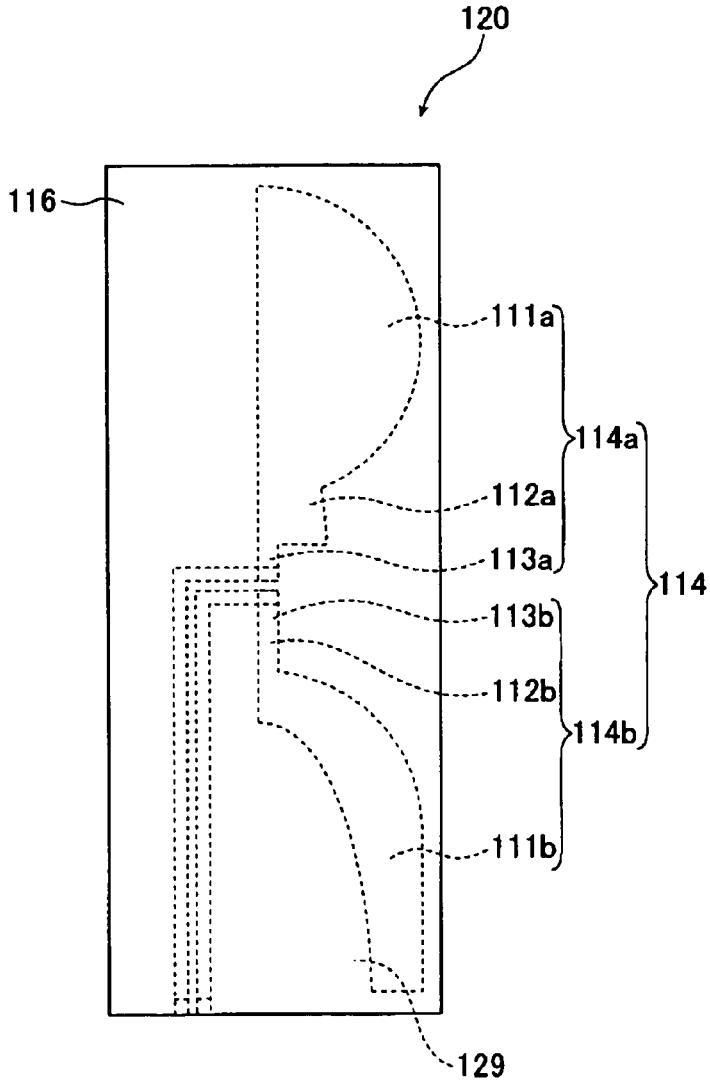
FIG. 14 is a plan view of the antenna body in the antenna device according to another embodiment of the present invention.

An antenna body 120 shown in FIG. 14 may be employed instead of the antenna body 120 shown in FIG. 11.

In the antenna body 120 shown in FIG. 14, $W_1$, $W_2$ and $W_3$ in a radiating conductor 114*a* are set so as to satisfy the condition of $W_1>W_2>W_3$. On the other hand, although a radiating conductor 114*b* has a cut-out portion 129 formed as in the antenna body 120 shown in FIG. 11, $W_1$, $W_2$ and $W_3$ in the radiating conductor 114*b* are set so as to satisfy the condition of $W_1>W_2=W_3$ (or $W_1>W_2\approx W_3$). A portion of the second forming element 112*b* close to the third forming element 113*b* in the radiating conductor 114*b* is formed in a band-like shape, and the remaining portion of the second forming element close to the first forming element 111*b* is formed in a shape to bridge a gap between the band-like portion and the first forming element 111*b*. The width of the band-like portion close to the third forming element 113*b* is the maximum length of the second forming element 112*b*. An end portion of the second forming element 112*b* in contact with the third forming element 113*b* in the radiating conductor 114*b* has the maximum length of the second forming element 112*b*, being smoothly jointed with the third forming element 113*b*. In other words, the second forming element 112*a* of the radiating conductor 114*a* projects in a lump-like shape in the radiating conductor 114*a* while the second forming element 112*b* does not project in a lump-like shape in the radiating conductor 114*b*.

Figure 15:
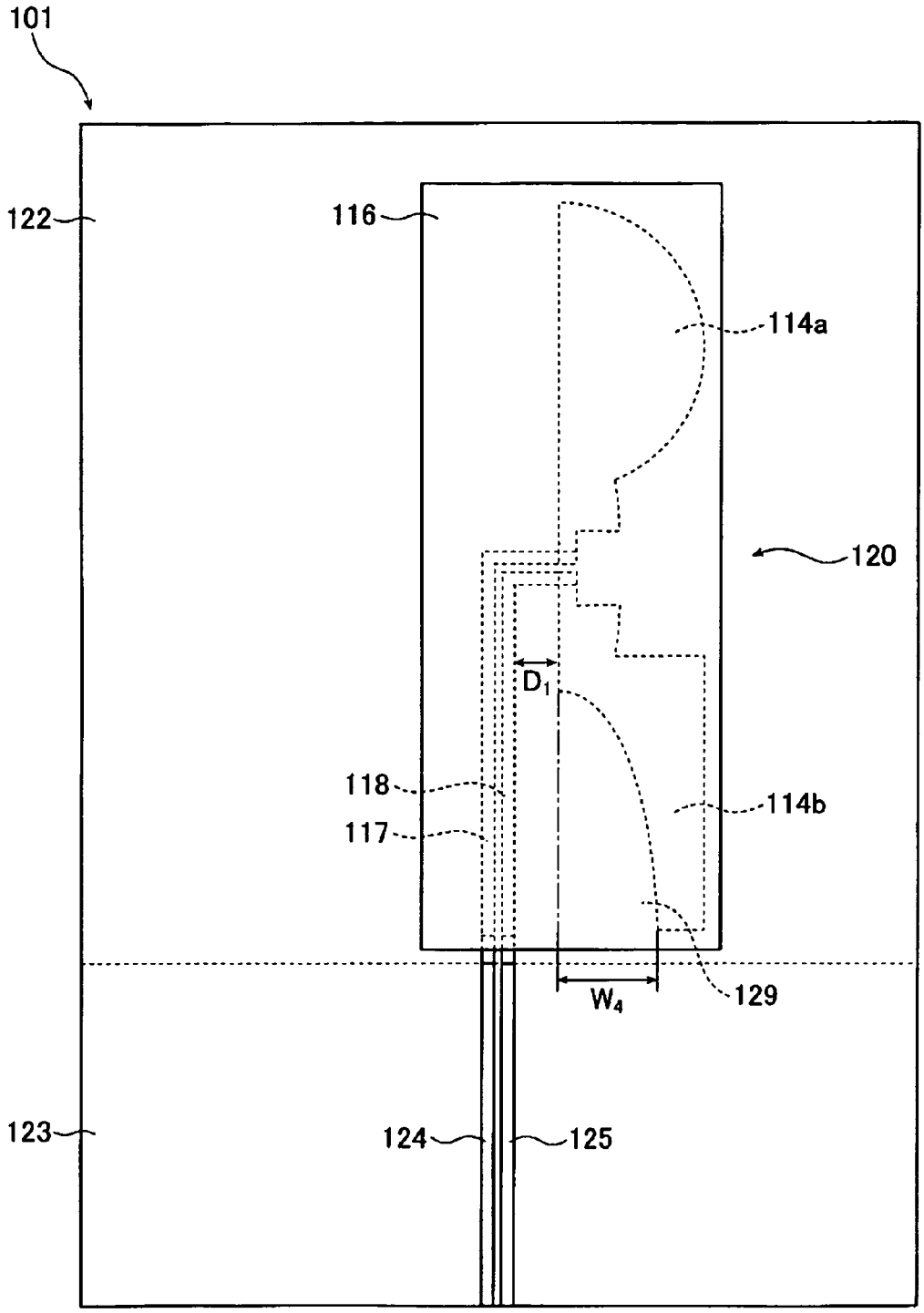
FIG. 15 is a plan view of the antenna body in the antenna device according to another embodiment of the present invention.

An antenna body 120 shown in FIG. 15 may be employed instead of the antenna body shown in FIG. 11.

The antenna body 120 shown in FIG. 11 is configured so that the first forming element 111*b* has the cut-out portion 129 disposed in a combination of the rectangular shape 111*c* and the ¼ circular shape 111*d*. On the other hand, the antenna body 120 shown in FIG. 15 is configured to have a cut-out portion 129 disposed in a rectangular shape (including an oblong shape or a square shape) instead of such a combination.

Figure 16A:
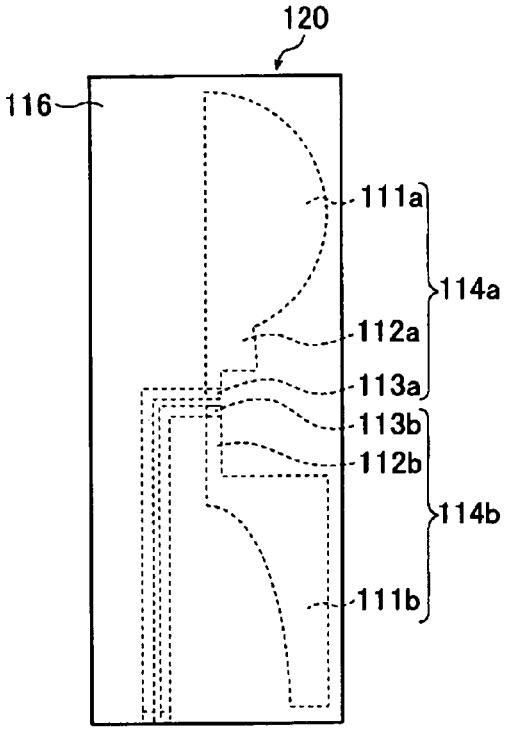
FIGS. 16(*a*) and (*b*) are plan views of the antenna bodies in the antenna devices according to other embodiments of the present invention.
Figure 16B:
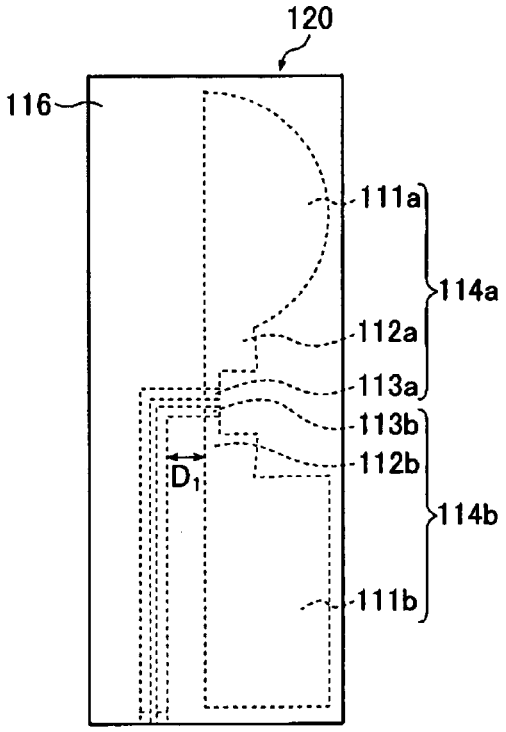

Antenna bodies 120 shown in FIGS. 16(*a*) and (*b*) may be employed instead of the antenna body 120 shown in FIG. 11.

In the antenna body 120 shown in FIG. 16(*a*), $W_1$, $W_2$ and $W_3$ in a radiating conductor 114*b* are set so as to satisfy the condition of $W_1>W_2=W_3$ (or $W_1>W_2\approx W_3$). In the radiating conductor 114*b*, a portion of a second forming element 112*b* close to a third forming element 113*b* is formed in a band-like shape, and the remaining portion of the second forming element close to a first forming element 111*b* formed in a shape to bridge a gap between the band-like portion and the first forming element 111*b*. The width of the band-like portion close to the third forming element 113*b* is the maximum length of the second forming element 112*b*. In the radiating conductor 114*b*, an edge portion of the second forming element 112*b* in contact with the third forming element 113*b* has the maximum length of the second forming element 112*b*, being smoothly jointed to the third forming element 113*b*. In other words, a second forming element 112*a* of a radiating conductor 114*a* projects in a lump-like shape in the radiating conductor 114*a* while the second forming element 112*b* does not project in a lump-like shape in the radiating conductor 114*b*.

On the other hand, the antenna body 120 shown in FIG. 16(*b*) is configured to include a radiating conductor 114*b* without the cut-out portion 129 of the antenna body 120 shown in FIG. 15.

Figure 17A:
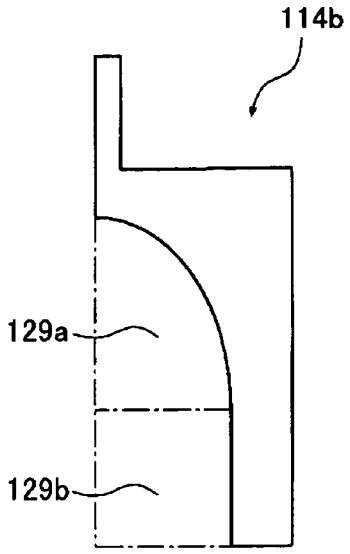
FIGS. 17(*a*) and (*b*) are schematic views explaining cut-out portions of antenna bodies, which are employed in the antenna device according to the present invention.
Figure 17B:
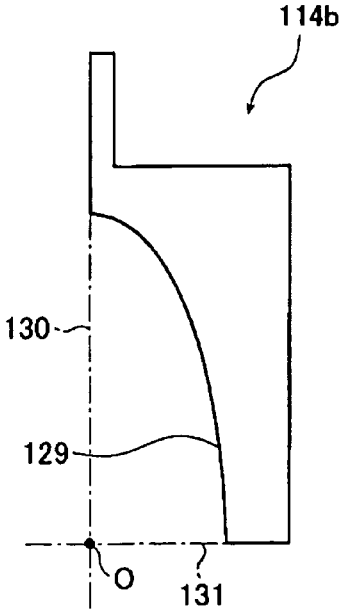

The cut-out portion 129 may be provided by cutting out in a curved shape or combining a first shape 129*a* selected among a ¼ circular shape, a ¼ substantially circular shape, a ¼ oval shape and a ¼ substantially oval shape, and a second shape 129*b* formed in a rectangular shape and jointed to the first shape 129*a*, as shown in FIG. 17(*a*). In the case of a ¼ oval shape and a ¼ substantially oval shape, the cut-out portion is configured so that a linear side forming the minor axis of the first shape is jointed to a side of the second shape 129*b* having the same length as the linear side, and that another side forming the major axis of the first shape and another side of the second shape 129*b* are disposed in parallel with each other in the vertical direction in this figure. The cut-out portion is configured to have an arc portion of the first shape 129*a* facing the feed points and the second shape 129*b* facing the opposite side of the feed points.

When it is assumed that the radiating conductor 114*b* does not have the cut-out portion 129 disposed therein, the radiating conductor 114*b* has a pair of linear sides 130 and 131, and the paired sides 130 and 131 share an apex O as shown in FIG. 17(*b*). In this case, it is preferred that the circle shape, the substantially circle shape, the oval shape or the substantially oval shape that is the original shape of the selected ¼ circular shape, ¼ substantially circular shape, ¼ oval shape or ¼ substantially oval shape forming the entire cut-out portion 129 or a portion of thereof have the center located in the vicinity of the apex O. In the present invention, it is preferred that the original circular shape, the original substantially circular shape, the original oval shape or the original substantially oval shape have the center located in the vicinity of the side 130.

In accordance with the present invention, it is possible to provide a compact antenna device, which is capable of reducing a lower limit frequency in comparison with the conventional antenna devices, of having a high degree freedom in design and of having a higher gain and a wider bound, without having a large occupied area, by adjusting the shape of the radiating conductor and the shape of the cut-out portion in various ways as stated earlier.

Now, the transmission and reception characteristics of the antenna device 1 according to the present invention will be explained.

Figure 18:
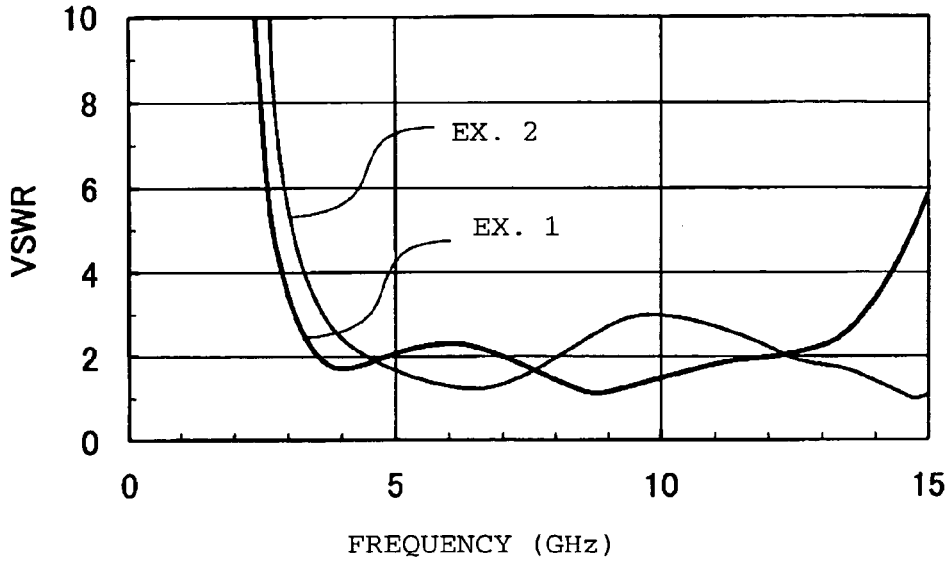
FIG. 18 is a graph showing an example of a frequency characteristic of VSWR of the antenna device shown in FIGS. 2 and 3.

FIG. 18 is examples of a frequency characteristic of VSWR (Voltage Standing Wave Ratio) of the antenna device 1 shown in FIGS. 2 and 3. In general, when a transmission line is connected to a load, such as an antenna, or connected to, e.g., another transmission line having a different characteristic impedance, a portion of a traveling wave is reflected to generate a backward wave by discontinuity of the connected portion. The backward wave coexists with the traveling wave on the same transmission line to generate a standing wave. VSWR is the ratio of the maximum value to the minimum value of a voltage signal, which appears as the standing wave at that time. This means that as VSWR is closer to 1, the antenna body 10 is provided with better impedance matching with the result that the return loss of the antenna body 10 is minimized to improve characteristics.

FIG. 18 shows examples of frequency characteristics of VSWR of the antenna devices (in Example 1 and Example 2 stated later).

In the frequency characteristics of VSWR shown in FIG. 18, VSWR is represented by a vertical axis, and frequencies are represented by a horizontal axis. From the viewpoint stated earlier, the range of frequencies, wherein VSWR is closer to 1, needs to be wide in order to obtain an operating frequency covering a wide range. When VSWR is less than 3.0, there is no problem in terms of antenna operation since it is possible to provide good transmission and reception characteristics. From this viewpoint, by making use of a frequency bandwidth, which has VSWR of less than 3.0 in the frequency characteristic of VSWR, it is possible to determine whether an operating frequency can cover a wide range. Accordingly, it is possible to determine whether an operating frequency band is wide or narrow, finding a fractional bandwidth defined by the following formula (wherein $f_H$ is an upper limit frequency having VSWR of less than 3, and $f_L$ is a lower limit frequency:

$$\text{fractional bandwidth}=2\cdot(f_H-f_L)/(f_H+f_L)\times 100\ (\%)$$

It is meant that a wider fractional bandwidth has a wider operating frequency bandwidth. The antenna device according to the present invention is in particular effective for communication in a frequency range from 3 to 11 GHz in a microwave range.

Next, the antenna device according to the present invention will be specifically described in terms of antenna characteristics based on examples of the antenna device.

FIG. 18 is a graph showing frequency characteristics of VSWR in Example 1 and Example 2 stated below. These frequency characteristics are found in accordance with electromagnetic field simulation by the FI (Finite-Integration) method.

EXAMPLE 1 (EXAMPLE)

Example 1 is an example, which employs the antenna device 1 having the antenna body 10 shown in FIG. 1. Each of the first forming elements 11*a* and 11*b* is formed in a semi-circular shape. Each of the second forming elements 12*a* and 12*b* has a portion thereof formed in a ¼ oval shape. Each of the third forming elements 13*a* and 13*b* is formed in a band-like shape. The radiating conductor 14 is disposed at a substantially central portion in the thickness direction of the dielectric member 16. The antenna body 10 is mounted to a surface of the insulating substrate 22 as shown in FIG. 2. Dimensions of the respective forming elements and the dielectric member 16 are listed, along with dimensions in Example 3 to Example 7 stated later, in Table 1 below. References $L_3$ and $L_4$ designate the length in the vertical direction and the length in the horizontal direction shown in FIG. 1 and FIG. 8, respectively.

TABLE 1

Figure 10A:
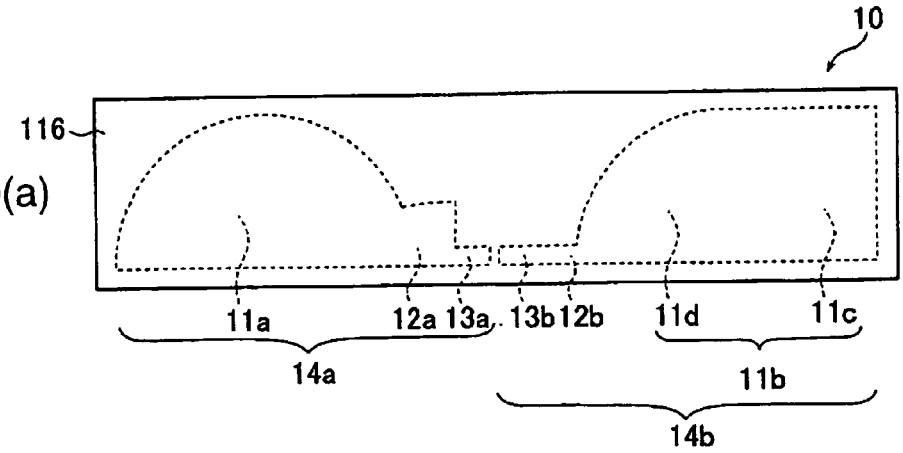
FIGS. 10(*a*) to (*d*) are plan views of the antenna body in the antenna devices according to other embodiments of the present invention.
Figure 10B:
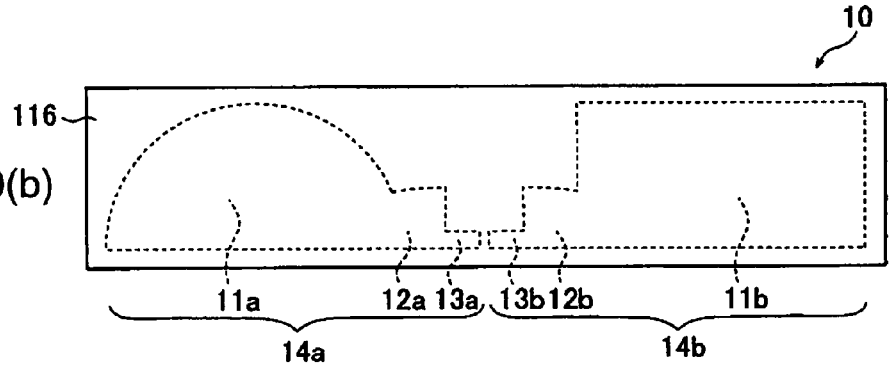
Figure 10C:
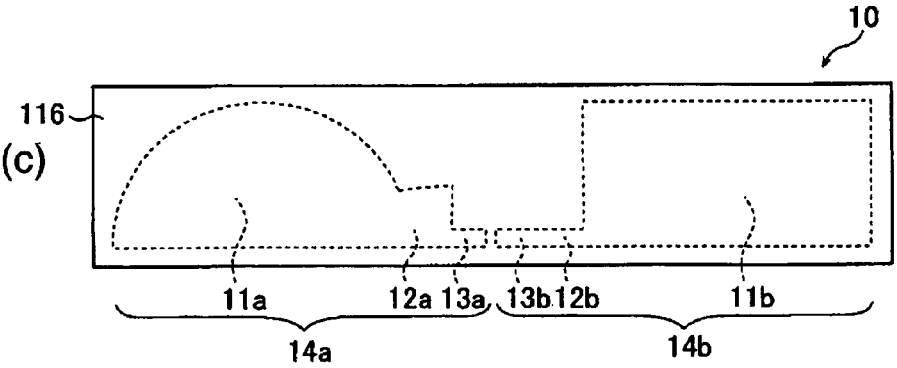
Figure 10D:
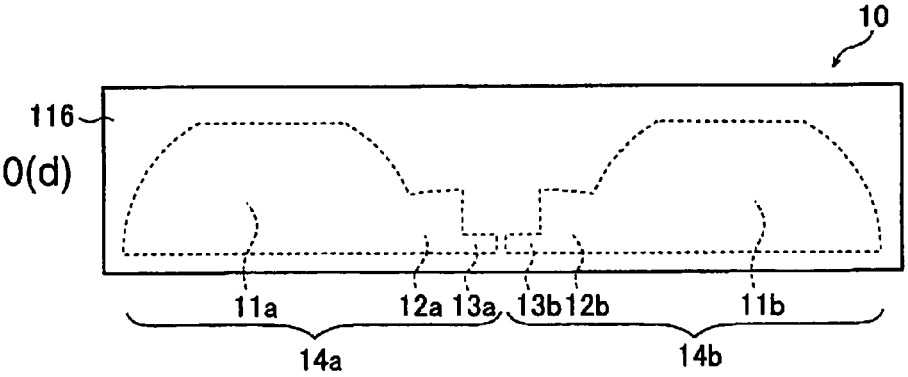

| | | | | Ex. 1 FIG. 1 | Ex. 3 FIG. 5 | Ex. 4 FIG. 8 | Ex. 5 FIG. 10(b) | Ex. 6 FIG. 11 | Ex. 7 FIG. 15 |
|---|---|---|---|---|---|---|---|---|---|
| First forming element | Semi-circular shape | | Diameter (mm) | 14 | 14 | — | 14 | — | 14 |
| | | | $W_1$ (mm) | 7 | 7 | | 7 | | 7 |
| | ¼ circular shape + square shape | ¼ circular shape | Radius (mm) | — | — | 7 | — | 7 | — |

TABLE 1-continued

| | | | | Ex. 1 FIG. 1 | Ex. 3 FIG. 5 | Ex. 4 FIG. 8 | Ex. 5 FIG. 10(b) | Ex. 6 FIG. 11 | Ex. 7 FIG. 15 |
|---|---|---|---|---|---|---|---|---|---|
| | | Square shape | One side (mm) | — | — | 7 | — | 7 | — |
| | | | $W_1$ (mm) | | | 7 | | 7 | |
| | Oblong shape | | Long side (mm) | — | — | — | 14 | — | 14 |
| | | | Short side (mm) | | | | 7 | | 7 |
| | | | $W_1$ (mm) | | | | 7 | | 7 |
| Second forming element | ¼ oval shape | Major axis radius (mm) | | 9 | 9 | 9 | 9 | 9 | 9 |
| | | Minor axis radius (mm) | | 2 | 2 | 2 | 2 | 2 | 2 |
| | | $L_1$ (mm) | | 1.5 | 1.5 | 1.5 | 1.5 | 1.5 | 1.5 |
| | | $W_2$ (mm) | | 2 | 2 | 2 | 2 | 2 | 2 |
| Third forming element | Band-like shape | $L_2$ (mm) | | 0.7 | 0.7 | 1.0 | 1.0 | 1.0 | 1.0 |
| | | $W_3$ (mm) | | 0.1 | 0.2 | 0.2 | 0.2 | 0.2 | 0.2 |
| Cut-out portion | ¼ oval shape | Major axis radius (mm) | | — | — | — | — | 10 | 10 |
| | | Minor axis radius (mm) | | | | | | 5 | 2.5 |
| Dielectric member | | | $L_3$ (mm) | 7 | 7 | 7 | 7 | 8.75 | 8.75 |
| | | | $L_4$ (mm) | 32.5 | 32.5 | 33.3 | 33.3 | 33.3 | 33.3 |

EXAMPLE 2 (COMPARATIVE EXAMPLE)

Figure 28:
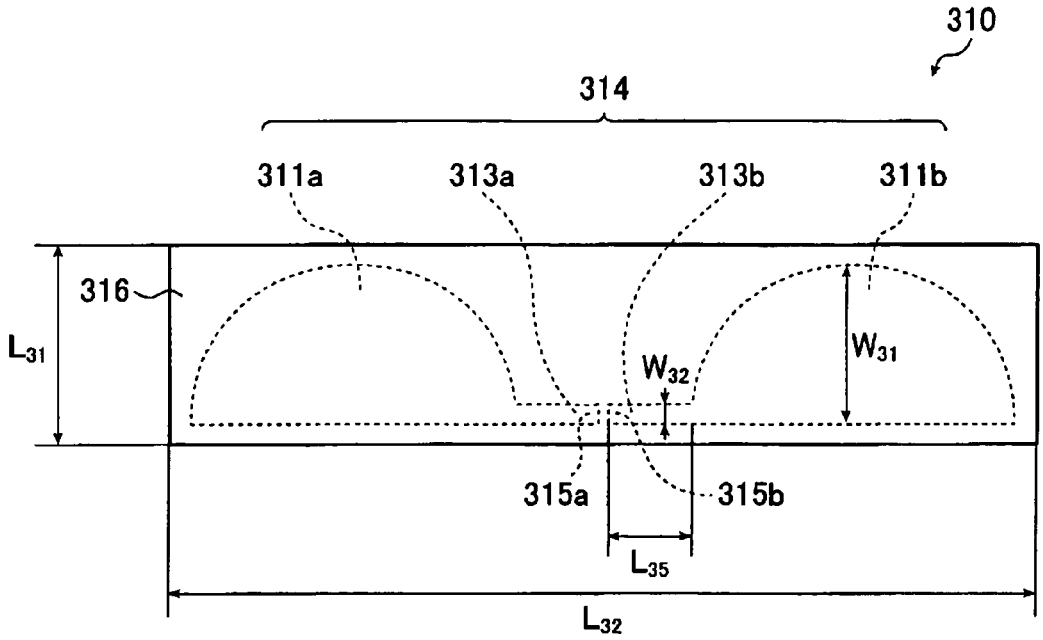
FIG. 28 is a schematic view of an antenna device, which has a different structure from the antenna device according to the present invention.

Example 2 is an example wherein an antenna body 310 shown in FIG. 28, instead of the antenna body 10 shown in FIG. 1, is employed in the antenna device. The antenna body 310 includes a radiating conductor 314 configured to comprise forming elements 311*a* and 311*b* formed in a semi-circular shape and forming elements 313*a* and 313*b* formed in a band-like shape, and the radiating conductor is different from that in Example 1 in that there is no second forming element 12*a* or 12*b*. For this reason, Example 2 is not an antenna device according to the present invention. In FIG. 28, reference numerals 315*a* and 315*b* designate feed points.

The forming elements 311*a* and 311*b* in Example 2 are formed in the same shape as the first forming elements 11*a* and 11*b* in Example 1. The forming elements 313*a* and 313*b* are formed in the same band-like shape as the third forming elements 13*a* and 13*b* in Example 1. The radiating conductor 314 is disposed at a substantially central portion in the thickness direction of a dielectric member 316. The antenna body 310 is mounted to a surface of the insulating substrate 22 as shown in FIG. 2. Dimensions of the respective forming elements and the dielectric member 316 are listed as follows:

| | |
|---|---|
| Forming elements 311a and 311b | |
| Diameter of semi-circular shape (=Maximum vertical length $W_{31} \times 2$) | 14 mm |
| Maximum vertical length ($W_{31}$, see FIG. 28) | 7 mm |
| Forming elements 313a and 313b | |
| Length of band-like shape ($L_{35}$, see FIG. 28) | 0.7 mm |
| Maximum vertical length ($W_{32}$, see FIG. 28) | 0.1 mm |
| Dielectric member 316 | |
| Relative dielectric constant | 10.0 |
| Vertical length ($L_{31}$, see FIG. 28) | 7 mm |
| Horizontal length ($L_{32}$, see FIG. 28) | 29.5 mm |

As shown in FIG. 18, the lower limit frequency wherein VSWR is 3.0 or below is 3.1 GHz in Example 1 as an example of the present invention and 3.7 GHz in Example 2 as a comparative example. The lower limit frequency in Example 1 is lower than that in Example 2 by 0.6 GHz. This reveals that Example 1 can reduce the lower limit frequency in comparison with Example 2 by about 20%.

The wavelength of the lower limit frequency at that time is about 96.8 mm. Since the diameter (=maximum vertical length $W_1 \times 2$) of each of the first forming elements 11*a* and 11*b* is 14 mm, it is revealed that the diameter of each of the first forming elements 11*a* and 11*b* needs to have a length equal to substantially 0.15 time a wavelength. Accordingly, the radiating conductor 14 needs to have an area of substantially 0.7 time a wavelength×substantially 0.3 time a wavelength (length in vertical direction×length in horizontal direction), and such an area is needed as an antenna area. This antenna area is smaller than the conventional antennas disclosed the first and second non-patent documents and the first patent document stated earlier (FIGS. 24 to 27). Thus, it is possible to realize an antenna device having a smaller size than the conventional antenna devices.

The fractional bandwidth of the frequency characteristic in Example 1 is 126% while the fractional bandwidth of the frequency characteristic in Example 2 is 88%. Example 1 has a wider fractional bandwidth and a wider operating frequency band.

Additionally, it is verified that an antenna device having the first forming elements 11*a* and 11*b* formed in a semi-oval shape, and an antenna device having the second forming elements 12*a* and 12*b* formed in an oblong shape (rectangular shape) also have a similar fractional bandwidth to Example 1.

As stated earlier, it is possible to realize a small size antenna by employing the radiating conductor 14 to reduce the occupied area of the antenna, the radiating conductor being configured to have the first forming elements 11*a* and 11*b*, the second forming elements 12*a* and 12*b*, and the third forming elements 13*a* and 13*b* jointed in one direction in this order. It is also possible to reduce the lower limit frequency in comparison with the conventional antennas.

By properly selecting and adjusting the shapes of the second forming elements 12*a* and 12*b* and the third forming elements 13*a* and 13*b* according to the dimensions of the first forming elements 11*a* and 11*b* in the radiating conductor 14, it is possible to realize optimum impedance matching over a wide range and to improve the fractional bandwidth. In other words, it is possible to realize an antenna device having a high degree freedom in design and having a wider band.

EXAMPLE 3 (EXAMPLE)

Example 3 is an example, which employs the antenna device 51 having the antenna body 60 shown in FIGS. 5 and 6.

Figure 19:
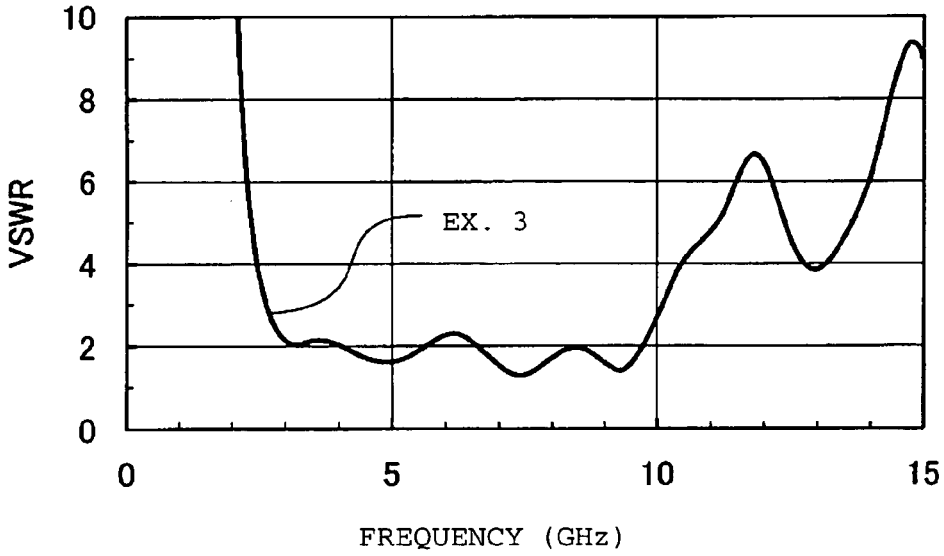
FIG. 19 is a graph showing an example of a frequency characteristic of VSWR of the antenna device shown in FIGS. 5 and 6.

FIG. 19 is a graph showing a frequency characteristic of VSWR in Example 3. The frequency characteristic in Example 3 is found in accordance with electromagnetic field simulation by the FI (Finite-Integration) method. Dimensions of the respective forming elements and the dielectric member 66 are listed in Table 1 shown earlier.

Since the radiating conductor 64 has the same shape as the radiating conductor shown in FIG. 4(*b*), the same dimensional references ($L_3$, $L_4$ and $L_6$) will be used in the following explanation. The vertical length and the horizontal length are the length in the vertical direction and the length in the horizontal direction in FIG. 5, respectively.

The dielectric member 66 comprises the first dielectric layer 66*a*, the second dielectric layer 66*b* and the third dielectric layer 66*c* defined below.

| Dielectric member 66 | |
|---|---|
| First dielectric layer 66a | |
| Relative dielectric constant | 7.2 |
| Thickness | 0.25 mm |
| Second dielectric layer 66b | |
| Relative dielectric constant | 20.0 |
| Thickness | 0.5 mm |
| Third dielectric layer 66c | |
| Relative dielectric constant | 7.2 |
| Thickness | 0.25 mm |
| Vertical length ($L_3$, see FIG. 5) | 7 mm |
| Horizontal length ($L_4$, see FIG. 5) | 32.5 mm |
| Paired signal lines 71a, 71b | |
| Line width | 0.25 mm |
| Line-space ($L_{16}$, see FIG. 5) | 0.3 mm |

As shown in FIG. 19, the lower limit frequency wherein VSWR is 3.0 or below is 2.6 GHz in Example 3 as an example. On the other hand, the lower limit frequency is 3.7 GHz in Example 2 as a comparative example. The lower limit frequency in Example 3 is lower than that in Example 2 by 1.1 GHz. This reveals that Example 3 can reduce the lower limit frequency in comparison with Example 2 by about 40%.

The fractional bandwidth of the frequency characteristic in Example 3 is 117%, and Example 3 has a wider fraction bandwidth and a wider operating frequency band than Example 2 having a fractional bandwidth of 3.7 GHz.

It is verified that an antenna device, wherein the antenna body 60 has the second forming elements formed in an oblique shape (rectangular shape), also has a similar fractional bandwidth.

As stated earlier, the antenna device 51 in Example 3 can reduce the occupied area of the antenna to be formed as a small size antenna and can reduce the lower limit frequency in comparison with the conventional antennas.

It is possible to properly select and adjust the shapes of the second forming elements and the third forming elements and to adjust the shape of the connection conductors 74 in accordance with the dimensions of the first forming elements in the radiating conductor 64. Thus, it is possible to realize optimum impedance matching over a wide range and to improve the fractional bandwidth. In other words, it is possible to realize an antenna device having a high degree of freedom in design and having a wider range.

EXAMPLE 4 (EXAMPLE)

Example 4 is an example, which employs the antenna body 10 shown in FIG. 8. The first forming element 11*a* is formed in a semi-circular shape, and the first forming element 11*b* is formed in a combination of a ¼ circular shape and a square shape. Each of the second forming elements 12*a* and 12*b* is formed in a ¼ oval shape. Each of the third forming elements 13*a* and 13*b* is formed in a band-like shape. The radiating conductor 14 is disposed at a substantially central portion in the thickness direction of the dielectric member 16. The antenna body 10 is mounted to a surface of an insulating substrate (not shown) having a ground conductor so that the antenna body 10 is apart from the ground conductor (not shown) by 1 mm in the vertical direction. The dielectric member 16 comprises a first dielectric material sandwiched between second and third dielectric materials, the first dielectric material having a relative dielectric constant of 20, and the second and third dielectric materials having a relative dielectric constant of 7.2. Dimensions of the respective forming elements and the dielectric member 16 are listed in Table 1 shown earlier.

Figure 20:
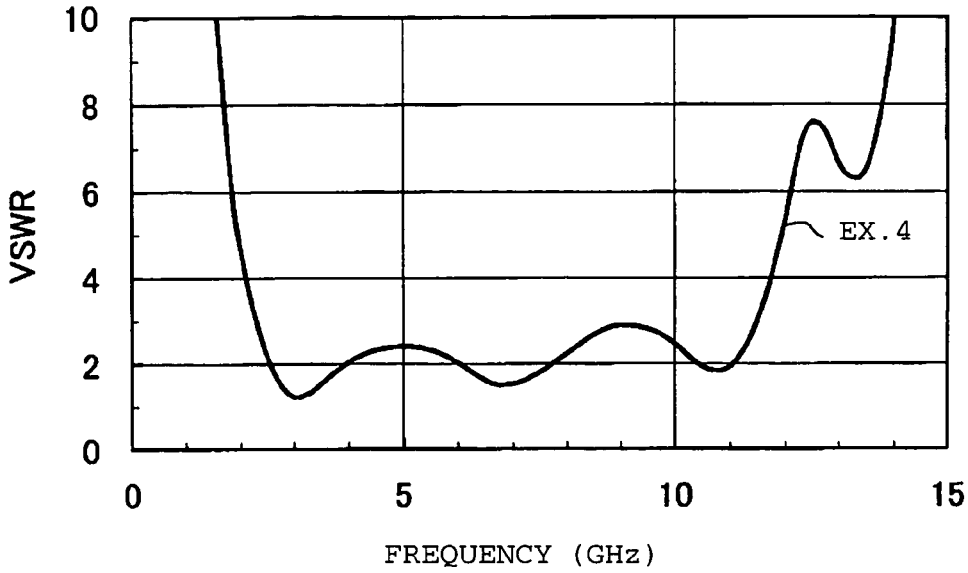
FIG. 20 is a graph showing an example of a frequency characteristic of VSWR of the antenna device in Example 4.

FIG. 20 is a graph showing a frequency characteristic of VSWR in Example 4. The frequency characteristic is found in accordance with electromagnetic field simulation by the FI (Finite-Integration) method.

EXAMPLE 5 (EXAMPLE)

Example 5 is related to the antenna body 10 shown in FIG. 10(*b*), which comprises the radiating conductor 14*a* formed in the same shape as the radiating conductor 14*a* shown in FIG. 8 and the radiating conductor 14*b* having the first forming element 11*b* formed in a rectangular shape. Dimensions of the respective forming elements and the dielectric member 16 are listed in Table 1 shown earlier.

Figure 21:
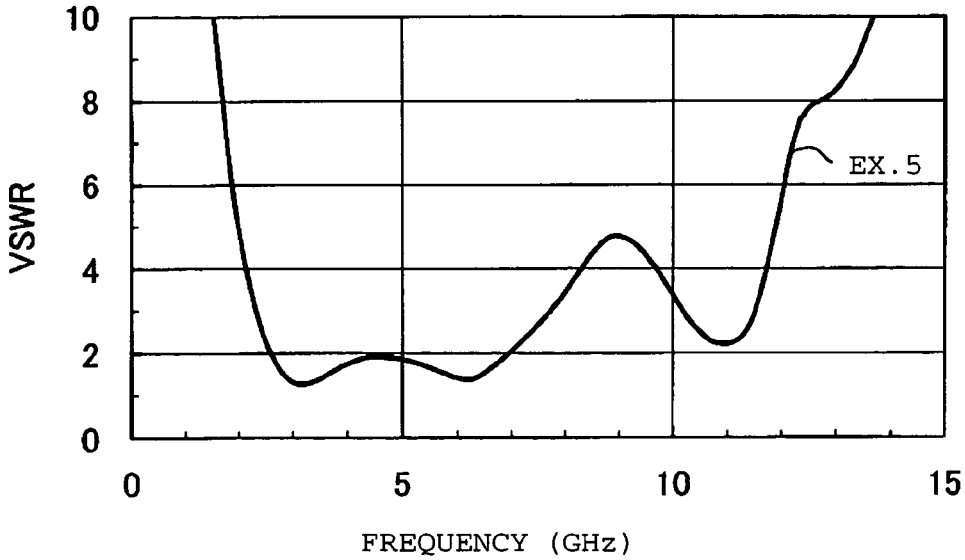
FIG. 21 is a graph showing an example of a frequency characteristic of VSWR of the antenna device in Example 5.

FIG. 21 is a graph showing a frequency characteristic of VSWR in Example 5. The frequency characteristic is found in accordance with electromagnetic field simulation by the FI (Finite-Integration) method.

EXAMPLE 6 (EXAMPLE)

Figure 22:
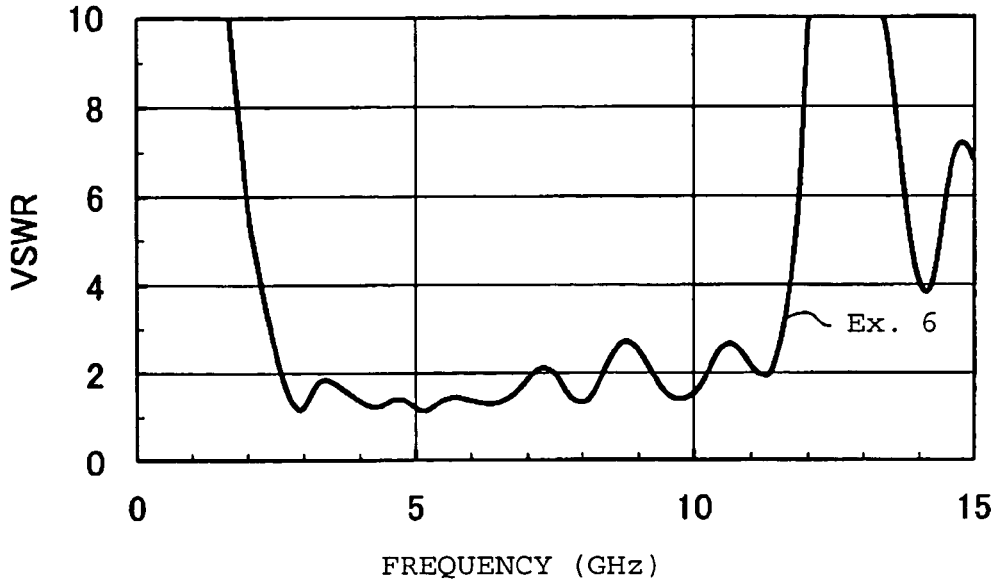
FIG. 22 is a graph showing an example of a frequency characteristic of VSWR of the antenna device in Example 6.

Example 6 is an example, which employs the antenna device 101 having the antenna body 120 shown in FIG. 11 and FIG. 12. In the antenna body 120, the first forming element 111*b* is configured by replacing a portion the first forming element 111*b* of the antenna body 120 shown in Example 4 (with a ¼ circular shape and a square shape combined therein) by a cut-out portion wherein a ¼ oval shape is cut out). FIG. 22 is a graph showing a frequency characteristic of VSWR in Example 6. The frequency characteristic is found in accordance with electromagnetic field simulation by the FI (Finite-Integration) method. Dimensions of the respective forming elements and the dielectric member 116 are listed in Table 1 shown earlier.

EXAMPLE 7 (EXAMPLE)

Figure 23:
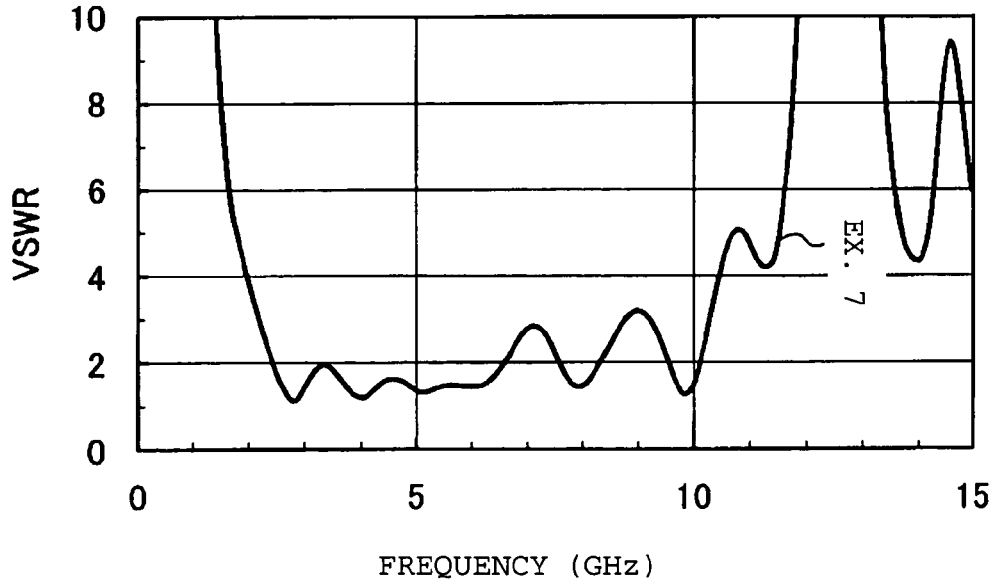
FIG. 23 is a graph showing an example of a frequency characteristic of VSWR of the antenna device in Example 7.
Figure 24:
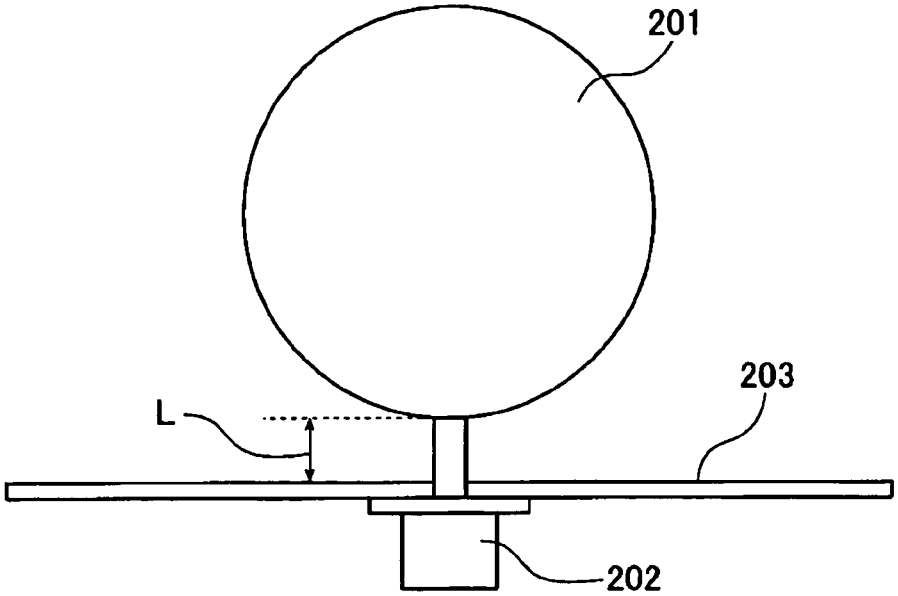
FIG. 24 is a schematic view showing a conventional disc monopole antenna.

Example 7 is related to the antenna device 120, which includes a radiating conductor 114*b* configured by forming a first forming element 111*b* in a rectangular shape and forming a cut-out portion 121 in the first forming element, the cut-out portion having being cut out in a ¼ oval shape, shown in FIG. 15. FIG. 23 is a graph showing a frequency characteristic of VSWR in Example 7. The frequency characteristic is found in accordance with electromagnetic field simulation by the FI (Finite-Integration) method. Dimensions of the respective forming elements and the dielectric member 116 are listed in Table 1 shown earlier. The distance $D_1$ between the radiating conductor 114*b* and one of the paired signal lines close to the radiating conductor 114*b* is set at 0.3 mm.

Figure 25:
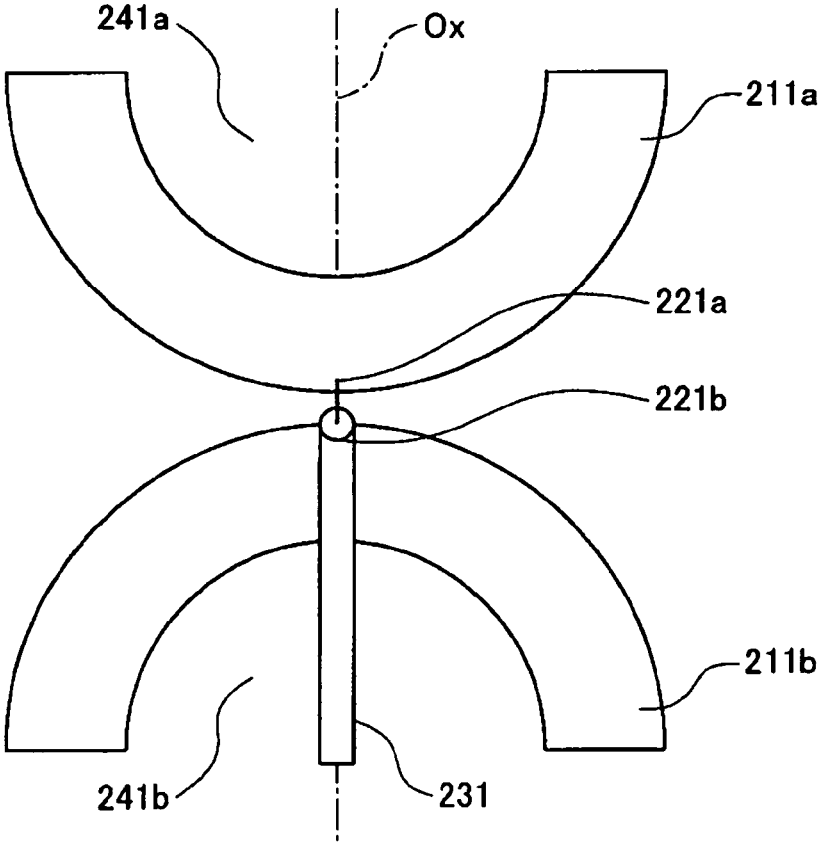
FIG. 25 is a schematic view showing an example of the conventional antennas.
Figure 26:
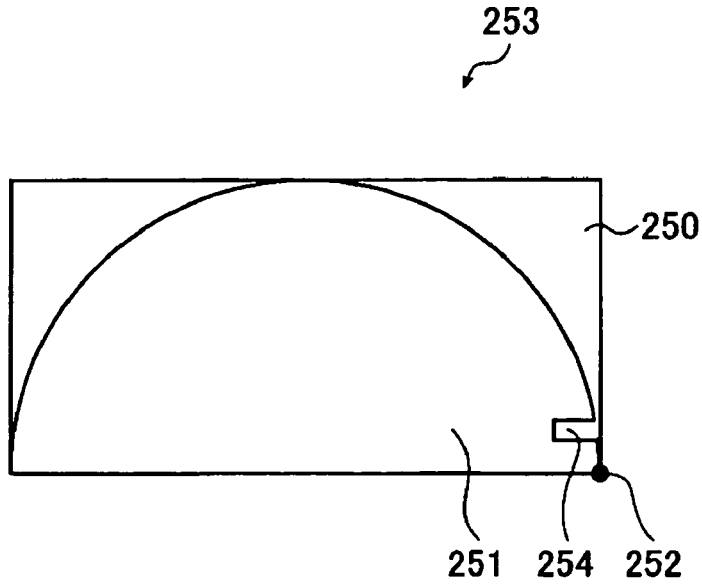
FIG. 26 is a schematic view showing an example of the conventional antennas.
Figure 27:
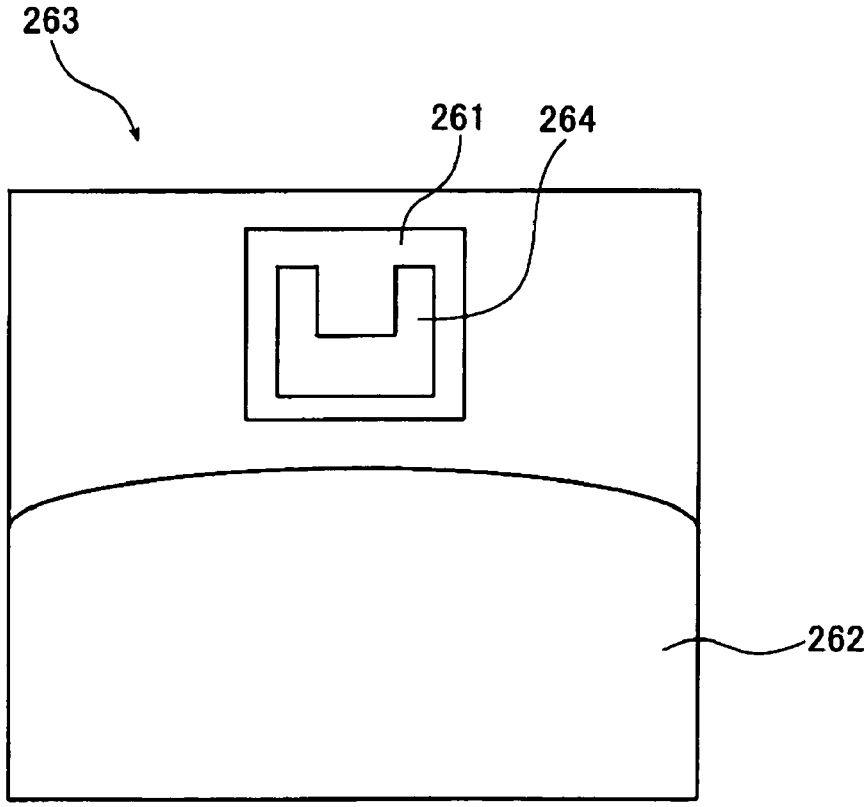
FIG. 27 is a schematic view showing an example of the conventional antennas.

The lower limit frequency wherein VSWR is 3.0 or below, the fractional bandwidth and the antenna area in each of Example 4, Example 5, Example 6 and Example 7 are listed in Table 2 shown below. As listed in Table 2, any one of the examples can reduce the lower limit frequency, have a wider fractional bandwidth and a smaller antenna area in comparison with the conventional antennas disclosed in the non-patent documents and the first patent document stated earlier (FIGS. 24 to 27). The antenna area of the antenna shown in FIG. 25 is substantially 0.3 time a wavelength×0.3 time a wavelength.

TABLE 2

| | Ex. 1 | Ex. 3 | Ex. 4 | Ex. 5 | Ex. 6 | Ex. 7 | Ex. 2 (Comp. Ex.) |
|---|---|---|---|---|---|---|---|
| Lower limit frequency (GHz) | 3.1 | 2.6 | 2.6 | 2.3 | 2.4 | 2.2 | 3.7 |
| Fractional bandwidth (%) | 126 | 117 | 126 | 109 | 131 | 120 | 88 |
| Antenna area | Substantially 0.07 time wavelength × Substantially 0.3 time wavelength | Substantially 0.07 time wavelength × Substantially 0.3 time wavelength | Substantially 0.07 time wavelength × Substantially 0.3 time wavelength | Substantially 0.07 time wavelength × Substantially 0.3 time wavelength | Substantially 0.09 time wavelength × Substantially 0.3 time wavelength | Substantially 0.09 time wavelength × Substantially 0.3 time wavelength | Substantially 0.07 time wavelength × Substantially 0.3 time wavelength |

As stated earlier, any one of the antenna devices in Example 1 and 3 to 7 can decrease the occupied area of the antenna to realize a small size antenna and can reduce the lower limit frequency in comparison with the conventional antenna devices.

It is possible to properly select and adjust the shapes of the first forming elements and the third forming element in the radiating conductor 14 in accordance with the dimensions of the first forming element in the radiating conductor 14. Thus, it is possible to obtain optimum impedance matching over a wider range and to improve the fractional bandwidth. In other words, it is possible to realize an antenna device having a high degree of freedom in design and having a wider range.

Although the antenna device according to the present invention has been described in detail, the present invention is not limited to the examples. It is to be understood that modification and variation of the present invention may be made without departing from the spirit and scope of the present invention.

The entire disclosures of Japanese Patent Application No. 2004-220302 filed on Jul. 28, 2004 and Japanese Patent Application No. 2004-371952 filed on Dec. 22, 2004 including specifications, claims, drawings and summaries are incorporated herein by reference in their entireties.

What is claimed is:

1. An antenna device comprising:

a dielectric member or a dielectric substrate and a radiating conductor formed in or on the dielectric member or the dielectric substrate, the radiating conductor being formed in a planar shape;

the radiating conductor having a conductor shape defined by a first forming element, a second forming element and a third forming element disposed in one direction, the radiating conductor being configured in such a single shape that the first forming element and the second forming element are jointed together and that the second forming element and the third forming element are jointed together;

the first forming element being formed in a shape selected among a semi-circular shape, a substantially semi-circular shape, a semi-oval shape, a substantially semi-oval shape, an arched shape and a substantially arched shape;

the third forming element being formed in a shape selected among a band-like shape, a substantially band-like shape, a rectangular shape and a substantially rectangular shape;

the first forming element and the third forming element being disposed to be apart from each other;

the second forming element being disposed to bridge a gap between the first forming element and the third forming element; and the third forming element having a feed point disposed therein;

wherein when it is assumed that the semi-circular shape, the substantially semi-circular shape, the semi-oval shape, the substantially semi-oval shape, the arched shape and the substantially arched shape of the first forming element has a chord extended beyond the second forming element to an edge portion of the third forming element remote from the first forming element, and that the extended portion of the chord is called an imaginary chord, an edge portion of the second forming element close to the imaginary chord and one side of the third forming element close to the imaginary chord overlap or substantially overlap with the imaginary chord; and wherein when maximum vertical lengths of the first forming element, the second forming element and the third forming element in a direction orthogonal to the one direction are represented by $W_1$, $W_2$ and $W_3$, respectively, $W_1$, $W_2$ and $W_3$ are set to satisfy the condition of $W_1>W_2>W_3$.

2. The antenna device according to claim 1, wherein an edge portion of the second forming element remote from the imaginary chord is parallel or substantially parallel with the imaginary chord in the direction orthogonal to the one direction.

3. The antenna device according to claim 1, wherein an edge portion of the second forming element remote from the imaginary chord is at least partly formed in an arc shape of a ¼ circular shape, a ¼ substantially circular shape, a ¼ oval shape or a ¼ substantially oval shape in the direction orthogonal to the one direction.

4. The antenna device according to claim 1, wherein an edge portion of the second forming element remote from the imaginary chord and an edge portion of the second forming element close to the third forming element are orthogonal or substantially orthogonal to each other.

5. The antenna device according to claim 1, wherein the second forming element is formed in a substantially quadrilateral shape, and the edge portion of the second forming element close to the imaginary chord forms one side of the substantially quadrilateral shape close to the imaginary chord.

6. The antenna device according to claim 1, wherein $W_1$, $W_2$ and $W_3$ are set to satisfy the condition of $0.07W_1 \leqq W_2 \leqq 0.6W_1$ and the condition of $0.01W_1 \leqq W_3 \leqq 0.06W_1$.

7. An antenna device comprising:

a dielectric member or a dielectric substrate and a pair of radiating conductors formed in or on the dielectric member or the dielectric substrate, the radiating conductors comprising a first radiating conductor and a second radiating conductor, the first radiating conductor and the second radiating conductor being formed in a planar shape and disposed on the same plane as each other so as to be confront each other;

each of the first radiating conductor and the second radiating conductor having a feed point disposed therein;

the first radiating conductor of the paired radiating conductors having a conductor shape defined by a first forming element, a second forming element and a third forming element disposed in one direction, the radiating conductor being configured in such a single shape that the first forming element and the second forming element are jointed together and that the second forming element and the third forming element are jointed together;

the third forming element of the first radiating conductor being disposed on a confronting side to confront the second radiating conductor;

the first forming element of the first radiating conductor being formed in a shape selected among a semi-circular shape, a substantially semi-circular shape, a semi-oval shape, a substantially semi-oval shape, an arched shape and a substantially arched shape;

the third forming element of the first radiating conductor being formed in a shape selected among a band-like shape, a substantially band-like shape, a rectangular shape and a substantially rectangular shape; and the first radiating conductor having the first forming element and the third forming element disposed to be apart from each other, and the second forming element disposed to bridge a gap between the first forming element and the third forming element;

wherein when it is assumed that the semi-circular shape, the substantially semi-circular shape, the semi-oval shape, the substantially semi-oval shape, the arched shape and the substantially arched shape of the first forming element in the first radiating conductor has a chord extended beyond the second forming element to an edge portion of the third forming element remote from the first forming element, and that the extended portion of the chord is called an imaginary chord, an edge portion of the second forming element close to the imaginary chord and one side of the third forming element close to the imaginary chord overlap or substantially overlap with the imaginary chord; and wherein when maximum vertical lengths of the first forming element, the second forming element and the third forming element in the first radiating conductor in a direction orthogonal to the one direction are represented by $W_{1A}$, $W_{2A}$ and $W_{3A}$, respectively, $W_{1A}$, $W_{2A}$ and $W_{3A}$ are set to satisfy the condition of $W_{1A}>W_{2A}>W_{3A}$.

8. The antenna device according to claim 7, further comprising:

the second radiating conductor having a conductor shape defined by a first forming element, a second forming element and a third forming element disposed in one direction, the radiating conductor being configured in such a single shape that the first forming element and the second forming element are jointed together and that the second forming element and the third forming element are jointed together;

the third forming element of the second radiating conductor being disposed on a confronting side to confront the first radiating conductor;

the first forming element of the second radiating conductor being formed in a shape selected among a semi-circular shape, a substantially semi-circular shape, a semi-oval shape, a substantially semi-oval shape, an arched shape and a substantially arched shape;

the third forming element of the second radiating conductor being formed in a shape selected among a band-like shape, a substantially band-like shape, a rectangular shape and a substantially rectangular shape; and the second radiating conductor having the first forming element and the third forming element disposed to be apart from each other, and the second forming element disposed to bridge a gap between the first forming element and the third forming element;

wherein when it is assumed that the semi-circular shape, the substantially semi-circular shape, the semi-oval shape, the substantially semi-oval shape, the arched shape and the substantially arched shape of the first forming element in the second radiating conductor has a chord extended beyond the second forming element to an edge portion of the third forming element remote from the first forming element, and that the extended portion of the chord is called a second imaginary chord, an edge portion of the second forming element close to the second imaginary chord and one side of the third forming element close to the second imaginary chord overlap or substantially overlap with the second imaginary chord;

wherein when maximum vertical lengths of the first forming element, the second forming element and the third forming element in the second radiating conductor in a direction orthogonal to the one direction are represented by $W_{1B}$, $W_{2B}$ and $W_{3B}$, respectively, $W_{1B}$, $W_{2B}$ and $W_{3B}$ are set to satisfy the condition of $W_{1B}>W_{2B}>W_{3B}$;

wherein when it is assumed that the second imaginary chord is indefinitely extended and called a second extended imaginary chord, the imaginary chord and a portion of the second extended imaginary chord overlap or substantially overlap each other; and wherein a main part of the first radiating conductor and a main part of the second radiating conductor are disposed on the same side as each other, having a boundary as the second extended imaginary chord.

9. The antenna device according to claim 8, wherein the first radiating conductor and the second radiating conductor are formed in the same shape or substantially the same shape as each other; and wherein the first radiating conductor has an area equal to from 0.85 time to 1.15 times that of the second radiating conductor.

10. The antenna device according to claim 7, further comprising:

the second radiating conductor having a conductor shape defined by a first forming element, a second forming element and a third forming element disposed in one direction, the radiating conductor being configured in such a single shape that the first forming element and the second forming element are jointed together and that the second forming element and the third forming element are jointed together;

the third forming element of the second radiating conductor being disposed on a confronting side to confront the first radiating conductor;

the first forming element of the second radiating conductor being formed in a shape selected among a semi-circular shape, a substantially semi-circular shape, a semi-oval shape, a substantially semi-oval shape, an arched shape and a substantially arched shape;

the third forming element of the second radiating conductor being formed in a shape selected among a band-like shape, a substantially band-like shape, a rectangular shape and a substantially rectangular shape; and the second radiating conductor having the first forming element and the third forming element disposed to be apart from each other;

wherein a portion of the second forming element close to the third forming element in the second conductor is formed in a shape selected among a band-like shape, a substantially band-like shape, a rectangular shape and a substantially rectangular shape, the remaining portion of the second forming element close to the first forming element is formed so as to bridge a gap between the portion of the second forming element close to the third forming element and the first forming element, and the portion of the second forming element close to the third forming element has a width in a direction orthogonal to the one direction, the width being a maximum width in the second forming element;

wherein when it is assumed that the semi-circular shape, the substantially semi-circular shape, the semi-oval shape, the substantially semi-oval shape, the arched shape and the substantially arched shape of the first forming element in the second radiating conductor has a chord extended beyond the second forming element to an edge portion of the third forming element remote from the first forming element, and that the extended potion of the chord is called a second imaginary chord, an edge portion of the second forming element close to the second imaginary chord and one side of the third forming element close to the imaginary chord overlap or substantially overlap with the second imaginary chord;

wherein when maximum vertical lengths of the first forming element, the second forming element and the third forming element in the second radiating conductor in the direction orthogonal to the one direction are represented by $W_{1B}$, $W_{2B}$ and $W_{3B}$, respectively, $W_{1B}$, $W_{2B}$ and $W_{3B}$ are set to satisfy the condition of $W_{1B}>W_{2B}=W_{3B}$ or $W_{1B}>W_{2B}\approx W_{3B}$;

wherein when it is assumed that the second imaginary chord is indefinitely extended and called a second extended imaginary chord, the imaginary chord and a portion of the second extended imaginary chord overlap or substantially overlap each other; and wherein a main part of the first radiating conductor and a main part of the second radiating conductor are disposed on the same side as each other, having a boundary as the second extended imaginary chord.

11. The antenna device according to claim 7, further comprising:

the second radiating conductor having a conductor shape defined by a first forming element, a second forming element and a third forming element disposed in one direction, the radiating conductor being configured in such a single shape that the first forming element and the second forming element are jointed together and that the second forming element and the third forming element are jointed together;

the third forming element of the second radiating conductor being disposed on a confronting side to confront the first radiating conductor;

the first forming element of the second radiating conductor being configured so that a first shape and a second shape are combined together, the first shape being selected among a ¼ circular shape, a ¼ substantially circular shape, a ¼ oval shape and a ¼ substantially oval shape, the second shape comprising a rectangular shape or a substantially rectangular shape, the first shape having a linear side, the second shape having a side equal to the linear side, and the linear side of the first shape and the side of the second shape being jointed together;

the third forming element of the second radiating conductor being formed in a shape selected among a band-like shape, a substantially band-like shape, a rectangular shape and a substantially rectangular shape; and the second radiating conductor having the first forming element and the third forming element disposed to be apart from each other, and the second forming element disposed to bridge a gap between the first forming element and the third forming element;

wherein when it is assumed that the second radiating conductor has a second linear side different from the linear side, extended beyond the second forming element to an edge portion of the third forming element remote from the first forming element, and that the extended linear side is called an imaginary side, an edge portion of the second forming element close to the imaginary side and one side of the third forming element close to the imaginary chord overlap or substantially overlap with the imaginary side;

wherein when maximum vertical lengths of the first forming element, the second forming element and the third forming element in the second radiating conductor in a direction orthogonal to the one direction are represented by $W_{1B}$, $W_{2B}$ and $W_{3B}$, respectively, $W_{1B}$, $W_{2B}$ and $W_{3B}$ are set to satisfy the condition of $W_{1B}>W_{2B}>W_{3B}$;

wherein when it is assumed that the imaginary side is indefinitely extended and called an extended imaginary side, the imaginary chord and a portion of the extended imaginary side overlap or substantially overlap each other; and wherein a main part of the first radiating conductor and a main part of the second radiating conductor are disposed on the same side as each other, having a boundary as the extended imaginary side.

12. The antenna device according to claim 7, further comprising:

the second radiating conductor having a conductor shape defined by a first forming element, a second forming element and a third forming element disposed in one direction, the radiating conductor being configured in such a single shape that the first forming element and the second forming element are jointed together and that the second forming element and the third forming element are jointed together;

the third forming element of the second radiating conductor being disposed on a confronting side to confront the first radiating conductor;

the first forming element of the second radiating conductor being configured so that a first shape and a second shape are combined together, the first shape being selected among a ¼ circular shape, a ¼ substantially circular shape, a ¼ oval shape and a ¼ substantially oval shape, the second shape comprising a rectangular shape or a substantially rectangular shape, the first shape having a linear side, the second shape having a side equal to the linear side, and the linear side of the first shape and the side of the second shape being jointed together;

the third forming element of the second radiating conductor being formed in a shape selected among a band-like shape, a substantially band-like shape, a rectangular shape and a substantially rectangular shape; and the second radiating conductor having the first forming element and the third forming element disposed to be apart from each other;

wherein a portion of the second forming element close to the third forming element in the second conductor is formed in a shape selected among a band-like shape, a substantially band-like shape, a rectangular shape and a substantially rectangular shape, the remaining portion of the second forming element close to the first forming element is formed so as to bridge a gap between the portion of the second forming element close to the third forming element and the first forming element, and the second forming element comprises the portion close to the third forming element and the remaining portion;

wherein when it is assumed that the second radiating conductor has a second linear side different from the linear side extended beyond the second forming element to an edge portion of the third forming element remote from the first forming element, and that the extended linear side is called an imaginary side, an edge portion of the second forming element close to the imaginary side and one side of the third forming element close to the imaginary chord overlap or substantially overlap with the imaginary side;

wherein the portion close to the third forming element in the second radiating conductor has a width in a direction orthogonal to the one direction, the width being a maximum width of the second forming element, and wherein when maximum vertical lengths of the first forming element, the second forming element and the third forming element in the second radiating conductor in the direction orthogonal to the one direction are represented by $W_{1B}$, $W_{2B}$ and $W_{3B}$, respectively, $W_{1B}$, $W_{2B}$ and $W_{3B}$ are set to satisfy the condition of $W_{1B}>W_{2B}=W_{3B}$ or $W_{1B}>W_{2B}\approx W_{3B}$;

wherein when it is assumed that the imaginary side is indefinitely extended and called an extended imaginary side, the imaginary chord and a portion of the extended imaginary side overlap or substantially overlap each other; and wherein a main part of the first radiating conductor and a main part of the second radiating conductor are disposed on the same side as each other, having a boundary as the imaginary side.

13. The antenna device according to claim 7, further comprising:

the second radiating conductor having a conductor shape defined by a first forming element, a second forming element and a third forming element disposed in one direction, the radiating conductor being configured in such a single shape that the first forming element and the second forming element are jointed together and that the second forming element and the third forming element are jointed together;

the third forming element of the second radiating conductor being disposed on a confronting side to confront the first radiating conductor;

the first forming element in the second radiating conductor being formed in a shape selected between a rectangular shape and a substantially rectangular shape;

the third forming element of the second radiating conductor being formed in a shape selected among a band-like shape, a substantially band-like shape, a rectangular shape and a substantially rectangular shape; and the second radiating conductor having the first forming element and the third forming element disposed to be apart from each other, and the second forming element disposed to bridge a gap between the first forming element and the third forming element;

wherein when it is assumed that the first forming element in the second radiating conductor has a first side adjacent to a second side of the first forming element between the first forming element and the second forming element, that the first side is called a principal side, that the principal side is extended beyond the second forming element to an end portion of the third forming element remote from the first forming element, and that the extended portion of the principal side is called an imaginary straight line, an edge portion of the second forming element close to the imaginary straight line and one side of the third forming element close to the imaginary straight line overlap or substantially overlap with the imaginary straight line;

wherein when maximum vertical lengths of the first forming element, the second forming element and the third forming element in the second radiating conductor in a direction orthogonal to the one direction are represented by $W_{1B}$, $W_{2B}$ and $W_{3B}$, respectively, $W_{1B}$, $W_{2B}$ and $W_{3B}$ are set to satisfy the condition of $W_{1B}>W_{2B}>W_{3B}$;

wherein when it is assumed that the imaginary straight line is indefinitely extended and called an extended imaginary straight line, the imaginary chord and a portion of the extended imaginary straight line overlap or substantially overlap each other; and wherein a main part of the first radiating conductor and a main part of the second radiating conductor are disposed on the same side as each other, having a boundary as the extended imaginary straight line.

14. The antenna device according to claim 7, further comprising:

the second radiating conductor having a conductor shape defined by a first forming element, a second forming element and a third forming element disposed in one direction, the radiating conductor being configured in such a single shape that the first forming element and the second forming element are jointed together and that the second forming element and the third forming element are jointed together;

the third forming element of the second radiating conductor being disposed on a confronting side to confront the first radiating conductor;

the first forming element of the second radiating conductor being formed in a shape selected between a rectangular shape and a substantially rectangular shape;

the third forming element of the second radiating conductor being formed in a shape selected among a band-like shape, a substantially band-like shape, a rectangular shape and a substantially rectangular shape; and the second radiating conductor having the first forming element and the third forming element disposed to be apart from each other, and the second forming element disposed to bridge a gap between the first forming element and the third forming element;

wherein when it is assumed that the first forming element in the second radiating conductor has a first side adjacent to a second side of the first forming element between the first forming element and the second forming element, that the first side is called a principal side, that the principal side is extended beyond the second forming element to an end portion of the third forming element remote from the first forming element, and that the extended portion of the principal side is called an imaginary straight line, an edge portion of the second forming element close to the imaginary straight line and one side of the third forming element close to the imaginary straight line overlap or substantially overlap with the imaginary straight line;

wherein the second forming element in the second radiating conductor has a width in a direction orthogonal to the one direction, the width being a maximum width of the second forming element, and wherein when maximum vertical lengths of the first forming element, the second forming element and the third forming element in the second radiating conductor in the direction orthogonal to the one direction are represented by $W_{1B}$, $W_{2B}$ and $W_{3B}$, respectively, $W_{1B}$, $W_{2B}$ and $W_{3B}$ are set to satisfy the condition of $W_{1B}>W_{2B}=W_{3B}$ or $W_{1B}>W_{2B}\approx W_{3B}$;

wherein when it is assumed that the imaginary straight line is indefinitely extended and called an extended imaginary straight line, the imaginary chord and a portion of the extended imaginary straight line overlap or substantially overlap each other; and wherein a main part of the first radiating conductor and a main part of the second radiating conductor are disposed on the same side as each other, having a boundary as the extended imaginary straight line.

15. The antenna device according to claim 7, wherein each of the first radiating conductor and the second radiating conductor has at least one portion formed in an arc shape selected among a semi-circular shape, a substantially semi-circular shape, a ¼ circular shape, a ¼ substantially circular shape, a semi-oval shape, a substantially semi-oval shape, a ¼ oval shape, a ¼ substantially oval shape, an arched shape and a substantially arched shape; and wherein each of the first radiating conductor and the second radiating conductor has a linear side in parallel or substantially parallel with the one direction, at least one of the radiating conductors has a portion of the arc shape formed with a cut-out shape linearly cut out in parallel or substantially parallel with the linear side, and the cut-out shape is formed in a portion of the arc shape remote from the linear side.

16. The antenna device according to claim 7, wherein the first radiating conductor and the second radiating conductor have respective feed points disposed at or in the vicinity of closest portions thereof.

17. The antenna device according to claim 16, wherein the respective feed points of the first radiating conductor and the second radiating conductor are connected to a pair of signal lines, respectively; and wherein each of the paired signal lines comprises a first linear portion and a second linear portion disposed in a substantially L-character shape, the first linear portion linearly extending along the one direction, and the second linear portion turning in a direction orthogonal to the one direction and linearly extending to feed power to the first radiating conductor or the second radiating conductor.

18. The antenna device according to claim 17, wherein the paired signal lines are disposed in the dielectric member, the paired signal lines are disposed on a plane different from and in parallel with the plane where the first radiating conductor and the second radiating conductor are disposed, and the paired signal lines are connected to the first radiating conductor and the second radiating conductor through conductors disposed in a direction perpendicular to the plane where the first radiating conductor and the second radiating conductor are disposed.

19. The antenna device according to claim 17, wherein the first linear portion of each of the paired signal lines is disposed in parallel or substantially parallel with the one direction on a side of the second radiating conductor, and a portion of the second radiating conductor close to the first linear portion of each of the paired signal lines is cut out so as to gradually expand a distance between the first linear portion and the second radiating conductor.

20. The antenna device according to claim 19, wherein the second radiating conductor is cut out in at least one of a linear way of a curved way so that the gap between the first linear portion and the second radiating conductor gradually expand from the closest portions of the first radiating conductor and the second radiating conductor toward an exterior side in the one direction.

21. The antenna device according to claim 20, wherein when a portion of the second radiating conductor with the cut-out shape formed therein is called a cut-out portion, the cut-out portion is formed in a cut-out shape having an arc shape selected among a ¼ circular shape, a ¼ substantially circular shape, a ¼ oval shape and a ¼ substantially oval shape;

wherein the cut-out shape has a one linear side of the arc shape disposed in parallel or substantially parallel with the one direction, and an arc portion of the arc shape is disposed to face toward the closest portions of the first radiating conductor and the second radiating conductor; and wherein the cut-out portion is disposed to extend from an intermediate position of the second radiating conductor along the one direction to an edge portion of the second radiating conductor toward a direction opposite the closest portions of the first radiating conductor and the second radiating conductor.

22. The antenna device according to claim 19, wherein the cut-out portion is configured so that an arc shape and a rectangular or substantially rectangular shape are combined together, the arc shape being selected among a ¼ circular shape, a ¼ substantially circular shape, a ¼ oval shape and a ¼ substantially oval shape, the arc shape having a linear side, the rectangular or substantially rectangular shape having a side equal to the linear side, and the linear side of the arc shape and the side of the rectangular or substantially rectangular shape being jointed together;

wherein the cut-out portion is configured so that a second linear side of the arc shape and a second linear side of the rectangular or substantially rectangular shape are disposed in parallel or substantially parallel with one direction, and that the arc portion of the arc shape is disposed to face toward the closest portions of the first radiating conductor and the second radiating conductor; and wherein the cut-out portion is disposed to extend from an intermediate position of the second radiating conductor along the one direction to an edge portion of the second radiating conductor toward a direction opposite the closest portions of the first radiating conductor and the second radiating conductor.

23. The antenna device according to claim 21, wherein when it is assumed that the second radiating conductor has no cut-out portion formed therein, the second radiating conductor has a portion formed with a linear side parallel or substantially parallel with the one direction, the portion having the cut-out portion formed therein, provided that the cut-out portion is formed; and wherein the circular shape, the substantially circular shape, the oval shape or the substantially oval shape, on which the arc shape is based to form an entire or a portion of the cut-out portion, has a center located on or in the vicinity of the linear side.

24. The antenna device according to claim 19, wherein when a portion of the second radiating conductor with the cut-out shape formed therein is called a cut-out portion; and wherein the second radiating conductor has a portion close to the first linear portion cut out in a direction orthogonal to the one direction, and wherein when the cut-out portion has a maximum cut-out width $W_4$ in the direction orthogonal to the one direction, and when the second radiating conductor has a maximum length $W_{1B}$ in the direction orthogonal to the one direction, $W_4/W_{1B}$ as a ratio of the maximum cut-out width $W_4$ to $W_{1B}$ satisfies the condition of $0.03 \leqq W_4/W_{1B} \leqq 1$.

25. The antenna device according to claim 7, further comprising:

the second radiating conductor having a conductor shape defined by a first forming element, a second forming element and a third forming element disposed in one direction, the radiating conductor being configured in such a single shape that the first forming element and the second forming element are jointed together and that the second forming element and the third forming element are jointed together;

the third forming element of the second radiating conductor being disposed on a confronting side to confront the first radiating conductor;

the first forming element of the second radiating conductor being formed in a shape selected among a semi-circular shape, a substantially semi-circular shape, a semi-oval shape, a substantially semi-oval shape, an arched shape, a substantially arched shape, a rectangular shape and a substantially rectangular shape; and the third forming element of the second radiating conductor being formed in a shape selected among a band-like shape, a substantially band-like shape, a rectangular shape and a substantially rectangular shape; and the second radiating conductor having the first forming element and the third forming element disposed to be apart from each other, and the second forming element disposed to bridge a gap between the first forming element and the third forming element;

wherein when the first radiating conductor of the paired radiating conductors has a total length $L_5$ of the first forming element and the second forming element in the one direction, and when the second radiating conductor of the paired radiating conductors has a total length $L_6$ of the first forming element and the second forming element in the one direction, $L_5$ and $L_6$ are set to satisfy the condition of $0.5 \leqq L_6/L_5 \leqq 1.5$.

26. An antenna device comprising:

a dielectric member or a dielectric substrate and a pair of radiating conductors disposed on or in the dielectric member or the dielectric substrate, the radiating conductors comprising a first radiating conductor and a second radiating conductor disposed on the same plane as each other;

the paired radiating conductors being disposed to confront each other along one direction; and the paired radiating conductors having feed points disposed at or in the vicinity of closest portions thereof, the feed points being fed power by paired signal lines extending in parallel with each other;

wherein each of the paired signal lines comprises a first linear portion and a second linear portion disposed in a substantially L-character shape on or in the dielectric member or the dielectric substrate, the first linear portion linearly extending along the one direction, and the second linear portion turning in a direction orthogonal to the one direction and linearly extending from the first linear portion to feed power to the paired radiating conductors; and wherein when the second radiating conductor is one of the paired radiating conductors close to the first linear portion of each of the paired signal lines, and when the first radiating conductor is the other radiating conductor confronting the second radiating conductor, the second radiating conductor has a linear side extending along at least the one direction in the vicinity of the feed points, and the second radiating conductor has a portion close to the paired signal lines cut out so as to have a gradually larger distance than a distance between the paired signal lines and the linear side.

* * * * *